US006583389B2

(12) United States Patent
Murooka et al.

(10) Patent No.: US 6,583,389 B2
(45) Date of Patent: Jun. 24, 2003

(54) IMAGE HEATING APPARATUS, HEATER FOR HEATING IMAGE AND MANUFACTURING METHOD THEREOF

(75) Inventors: Ken Murooka, Kita soma-gun (JP); Nobukazu Adachi, Yokohama (JP); Akira Hayakawa, Abiko (JP); Takeshi Niimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 09/778,929

(22) Filed: Feb. 8, 2001

(65) Prior Publication Data

US 2001/0032835 A1 Oct. 25, 2001

(30) Foreign Application Priority Data

Feb. 10, 2000 (JP) ..... 2000-033283
Feb. 10, 2000 (JP) ..... 2000-033284
Feb. 10, 2000 (JP) ..... 2000-033286

(51) Int. Cl.[7] ..... H05B 1/00
(52) U.S. Cl. ..... 219/216; 219/469; 219/470; 399/329; 399/335; 118/60; 492/46
(58) Field of Search ..... 219/216, 469–471; 399/329–335; 432/60, 228; 492/46; 118/60

(56) References Cited

U.S. PATENT DOCUMENTS 5,149,941 A * 9/1992 Hirabayashi et al. ..... 219/216
5,404,214 A 4/1995 Yoshimoto et al. ..... 355/285
5,532,806 A 7/1996 Sugita et al. ..... 355/285
5,592,276 A 1/1997 Ohtsuka et al. ..... 399/335
5,621,510 A 4/1997 Okuda et al. ..... 399/338
5,708,926 A 1/1998 Sagara et al. ..... 399/122
5,801,360 A 9/1998 Oba et al. ..... 219/216
5,852,763 A 12/1998 Okuda et al. ..... 399/329
5,999,787 A * 12/1999 Finsterwalder et al. ..... 399/329
6,360,074 B1 * 3/2002 Isogai ..... 399/333

FOREIGN PATENT DOCUMENTS

JP 63-313182 12/1988
JP 9-01600 1/1997
JP 10-27567 1/1998

* cited by examiner

*Primary Examiner*—Teresa Walberg
*Assistant Examiner*—Shawntina T. Fuqua
(74) *Attorney, Agent, or Firm*—Fitzpatrick, Cella, Harper & Scinto

(57) ABSTRACT

An image heating apparatus that has an elongated heater, a film having a surface which moves while in contact with a recording material bearing an image, wherein the image on the recording material is heated by heat emitted from the heater via the film. The heater has a substrate made of metal and the substrate has a convex portion in a longitudinal direction of the heater.

19 Claims, 23 Drawing Sheets

IMAGE HEATING APPARATUS, HEATER FOR HEATING IMAGE AND MANUFACTURING METHOD THEREOF

BACKGROUND OF THE INVENTION

1. Field of the Invention

The present invention relates to an image heating apparatus to be applied to image forming apparatuses of copying apparatuses, printers, etc. and more specifically to a heater to be applied to image heating apparatuses which use films.

2. Related Background Art

For convenience of description, an image forming apparatus which is used for heat fixing (fixing), as a permanent image, of an unfixed toner image formed and born on a recording material such as a transferring material, an Electrofax sheet or an electrographic recording paper by a transferring (indirect) method or a direct method will be taken as an example of image forming apparatuses such as electrophotograpgic apparatuses and electrographic recording apparatuses.

Conventionally, a heat roller type apparatus has been used frequently as an image forming apparatus. This apparatus comprises a fixing roller serving as a heat roller which is heated to a predetermined surface temperature by a built-in heat generating source such as a halogen lamp and a pressurizing roller which is in contact with the fixing roller under a pressure, leads a recording material as a member to be heated into a pressure contact nip (fixing nip portion) between the above described rollers, sandwiches and conveys the recording material in the pressure contact nip, thereby thermally fixing an unfixed toner image on a surface of the recording material with heat of the fixing roller in the pressure contact nip portion.

Since the fixing roller has a large heat capacity, loses heat in a large amount and is low in a thermal efficiency, however, the fixing roller requires a long time to be heated to a temperature suited for heating the member to be heated, is in lack of a quick start property and must be always kept at a high temperature even in a stand-by state, thereby consuming energy at a high rate contrary to energy saving. Furthermore, the fixing roller dissipates heat in the image forming apparatus even in the stand-by state, thereby posing a problem of temperature rise in the image forming apparatus.

Japanese Patent Application Laid-Open No. 63-313182 or the like therefore propose film heating type heating apparatuses as apparatuses which have quick start properties and permit energy saving as well as on-demand heating.

The film heating type heating apparatus comprises a planar heating member which has a small heat capacity (the so-called ceramic heater), a film which slides on the heating surface of the above described heating member and a pressurizing roller which forms a nip in cooperation with the heating member with the film interposed, catches a recording material in the above described nip, conveys the recording material together with the film and heats the above described recording material with heat transmitted from the heating member by way of the above described film. A heating apparatus which has such a configuration provides merit to permit configuring a heating member used as a heat source and a film for transmitting heat from the above described heating member so as to have heat capacities smaller than those of the heater and the heat roller of the heat roller type heating apparatus, thereby raising a temperature rapidly and saving electric power in a stand-by state.

FIGS. 12A, 12B and 12C are schematic configurational diagrams of the heating member: FIG. 12A being a partially cut view of a surface (to be brought into contact with a heat-resistant film 103) of the above described heating member 101, FIG. 12B being a rear view of the heating member 101 and FIG. 12C being an enlarged cross sectional view taken along a 12C—12C line in FIG. 12B.

In FIG. 12A showing the surface view of the heating member, reference numeral 111 denotes a ceramic substrate which is elongated in a lateral direction and made of alumina or the like, and reference numeral 112 denotes a heating resistor which is formed like a thin belt, disposed on a surface of the substrate 111 in a longitudinal direction and made of silver palladium. Reference numeral 115 denotes electrodes which are formed on a surface of a left end of the substrate so as to be electrically conductive to a left end of the heating resistor 112 and made of silver or the like. Reference numeral 113 denotes an insulating surface protective layer made of glass or the like which covers the heating resistor 112 except locations of the above described electrodes 115 and is formed on the surface of the substrate.

In FIG. 12B showing the rear surface of the heating member, reference numerals 116 and 116 denote two thin belt like electrically conductive patterns made of silver or the like which are formed in parallel with each other on the rear surface of the substrate from a right end of to an approximately middle portion of the substrate in a longitudinal direction of the substrate, reference numeral 114 denotes a temperature detecting resistor which is formed on the rear surface of the substrate so as to establish electrical conductivity between left ends of the two electrically conductive patterns 116.

An AC voltage is applied from a power supply circuit (not shown) across the two electrodes 115 and 115, whereby the heating resistor 112 generates heat from an overall length and the heating member is rapidly heated.

A temperature of the heating member 101 is detected with a temperature detecting resistor 114 disposed on the rear surface of the substrate, an output from the above described temperature detecting resistor 114 is fed from right ends of the electrically conductive patterns 116 and 116 (DC lines) to a power supply control circuit (not shown) and power supply to the above described DC line is controlled so that the temperature of the heating member 101 is maintained at a predetermined level. That is, temperature control of the heating member 101 is performed.

Alumina is conventionally used as the ceramic of the substrate of the heating member 101 and the substrate may be broken due to a thermal stress incase of remarkably thick paper passage or double feeding where portions outside paper ends (no-paper passage portions) are temporally apart from a pressurizing roller, heat is not taken by paper and the pressurizing roller, thereby causing an abrupt temperature rise (hereinafter referred to as temperature rise of the no-paper passage portions) and producing a large temperature gradient. As a measure to prevent such breakage, it is proposed to use, as a substrate, aluminum nitride which has a heat conductivity several times as high as that of alumina so that a large temperature gradient cannot be produced. However, aluminum nitride is remarkably expensive, thereby posing a problem that aluminum nitride requires a higher cost than alumina.

It is therefore conceivable to adopt a configuration in which a substrate made of a relatively inexpensive metal is coated with glass as an insulating layer, and a heating resistor and insulating glass are disposed over the insulating layer as on the conventional heating member.

However, a metal substrate poses a problem that the substrate is relatively liable to be deformed, thereby tending to be heated uniformly in a longitudinal direction of a heating member.

When a thin metal, for example stainless steel, is coated with glass in particular and the glass is set at a high temperature at a time of calcination, another problem is posed that a heating member is remarkably warped when the heating member returns to normal temperature due to a difference in thermal expansion between the metal and glass. It is conceivable that the warping may degrade an assembling property or remarkable warping may result in breakage of a heating resistor. Simple thickening of a substrate made of a metal for enhancing its rigidity will enlarge a heat capacity of an appliance, thereby degrading a quick start property.

SUMMARY OF THE INVENTION

An object of the present invention is to provide a heater for heating an image which is not deformed easily even when a metal substrate is used as well as a manufacturing method of the heater and an image heating apparatus.

Another object of the present invention is to provide a heater which uses a metal substrate, a heater for heating an image which improves slide of a film and an image heating apparatus.

Still another object of the present invention is to provide an image heating apparatus comprising an elongated heater, and a film having a surface which slides on the heater and another surface which moves in contact with a recording material bearing an image, wherein the image on the recording material is heated by heat emitted from the heater via the film, the heater has a substrate made of a metal and the substrate has a convex portion in a longitudinal direction the heater.

Still another object of the present invention is to provide a heater for heating an image comprising an elongated substrate and a heat generating layer disposed on the substrate, wherein the substrate is made of a metal and has a convex portion in a longitudinal direction of the substrate.

Still another object of the present invention is to provide an image heating apparatus comprising a heater and a film having a surface which slides on the heater and another surface which moves in contact with a recording material bearing an image, wherein the film has an endless shape, the film is disposed inside the film, the image on the recording material is heated by heat emitted from the heater via the film, the heater includes a substrate made of a metal and a heat generating layer disposed on a surface of the substrate on a side of the film, and a surface of the substrate on a side of the heat generating layer has a curved shape which is convex outside.

Still another object of the present invention is to provide a heater for heating an image comprising an elongated substrate and a heat generating layer disposed on the substrate, wherein the substrate is made of a metal and a surface of the substrate on a side of the heat generating layer has a curved shape which is convex outside.

Still another object of the present invention is to provide a manufacturing method of a heater comprising a step of forming a convex portion on an elongated substrate made of a metal and a step of forming at least one of an electrically insulating layer, a heat generating layer and a protective layer by calcination on a substrate on which a convex portion is formed.

Further objects of the present invention will be apparent from the following description.

DETAILED DESCRIPTION OF THE PREFERRED EMBODIMENTS

Now, embodiments of the present invention will be described on the basis of the accompanying drawings.

Figure 11:
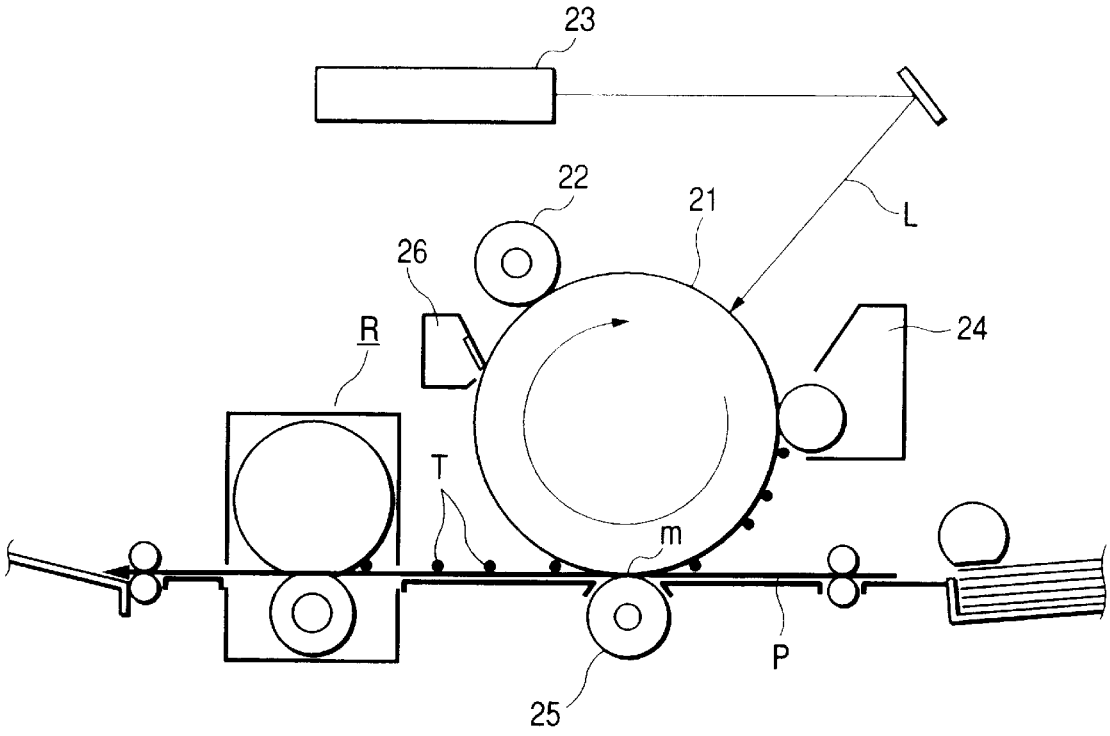
FIG. 11 is a diagram showing an image forming apparatus to which the present invention is applicable.
Figure 12A:
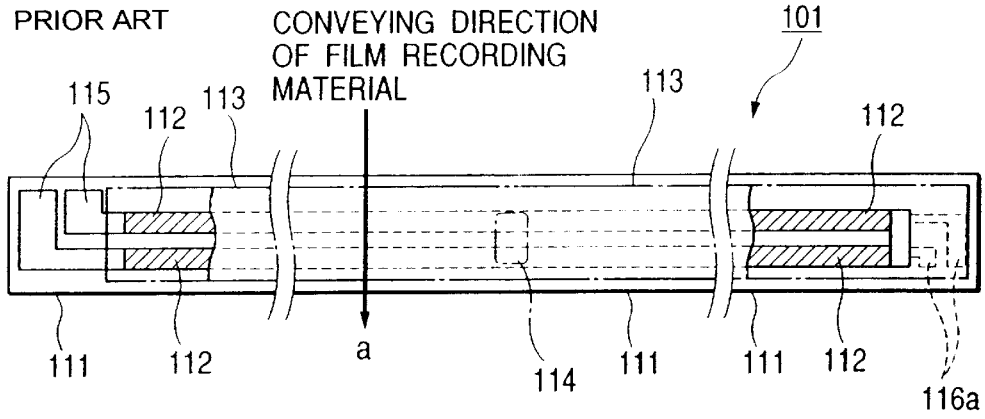
FIG. 12A PRIOR ART
FIGS. 12A, 12B and 12C are diagrams showing a conventional heater.
Figure 12B:
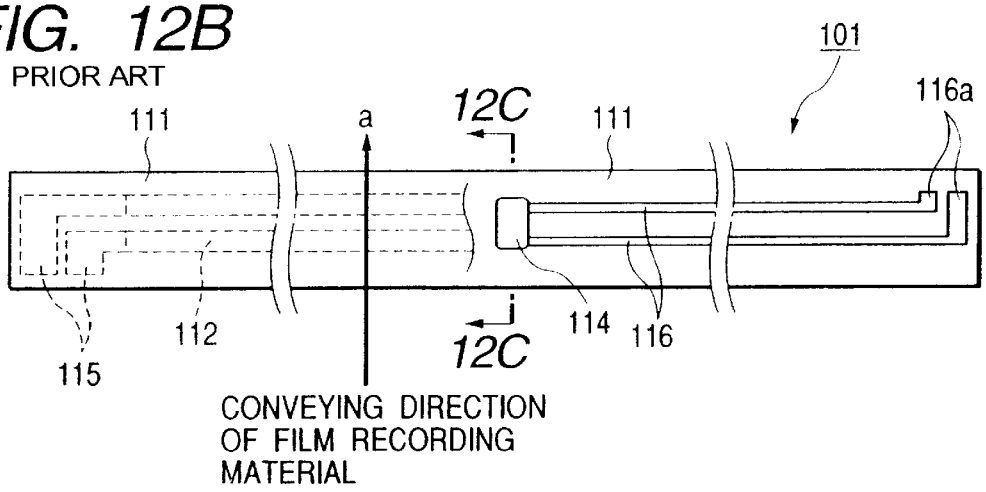
FIG. 12B PRIOR ART
Figure 12C:
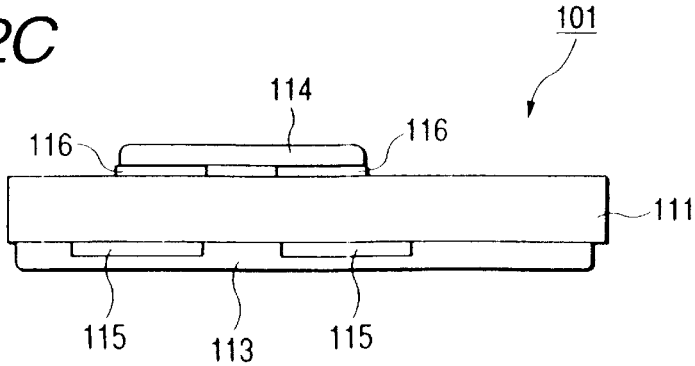
FIG. 12C PRIOR ART

FIG. 11 is a schematic configurational diagram of an example of image forming apparatus to which the present invention is applied. The image forming apparatus taken as the example is a laser beam printer utilizing an electrophotography process.

Reference numeral 21 denotes a rotating drum type electrophotographic photosensitive body (hereinafter referred to as a photosensitive drum) functioning as an image bearing body which is rotatingly driven at a predetermined peripheral speed (process speed) in a clockwise direction indicated by an arrow and uniformly charged during rotation at a negative predetermined dark potential $V_D$ by a primary charger 22.

Reference numeral 23 denotes a beam scanner which performs scanning exposure of a uniformly charged surface of the above described rotating photosensitive drum 21 by outputting a laser beam L modulated in correspondence to time series electric digital signals of object image information input from a host apparatus such as an image reading apparatus, a word processor or a computer.

This scanning exposure reduces an absolute value of a potential in an exposed area of the uniformly charged surface of the rotating photosensitive drum 21 to a bright potential $V_L$, thereby forming an electrostatic latent image corresponding to the object image information on the surface of the rotating photosensitive drum 21.

Then, the latent image is developed in reversal and visualized as a toner image T by a developing apparatus 24 with a negatively charged powder toner (the toner adheres to the area on the surface of the photosensitive drum which is exposed to the laser beam and set at the bright potential $V_L$).

On the other hand, a recording material P which is fed from a feed tray (not shown) is supplied to a pressure contact nip portion (transfer portion) m between a transferring roller 25 provided as a transferring member to which a transferring bias voltage is applied and the photosensitive drum 21 at an appropriate timing synchronized with a rotation of the photosensitive drum 21, and the toner image T is consecutively transferred from the surface of the photosensitive drum 21 to a surface of the above described recording material P.

The recording material P on which the unfixed toner image T is formed by image forming means composed of these component members 21, 22, 23, 24, 25 or the like is separated from the surface of the rotating photosensitive drum 21, led into a fixing apparatus (image heating apparatus) R, subjected to a fixing treatment of the toner image T and discharged as a print out of the image forming apparatus.

After the recording material has been separated, the surface of the rotating photosensitive drum 21 is cleaned into a clean surface by removing residues such as the toner remaining after transferring with a cleaning device 26 and used repeatedly for image formation.

Figure 10:
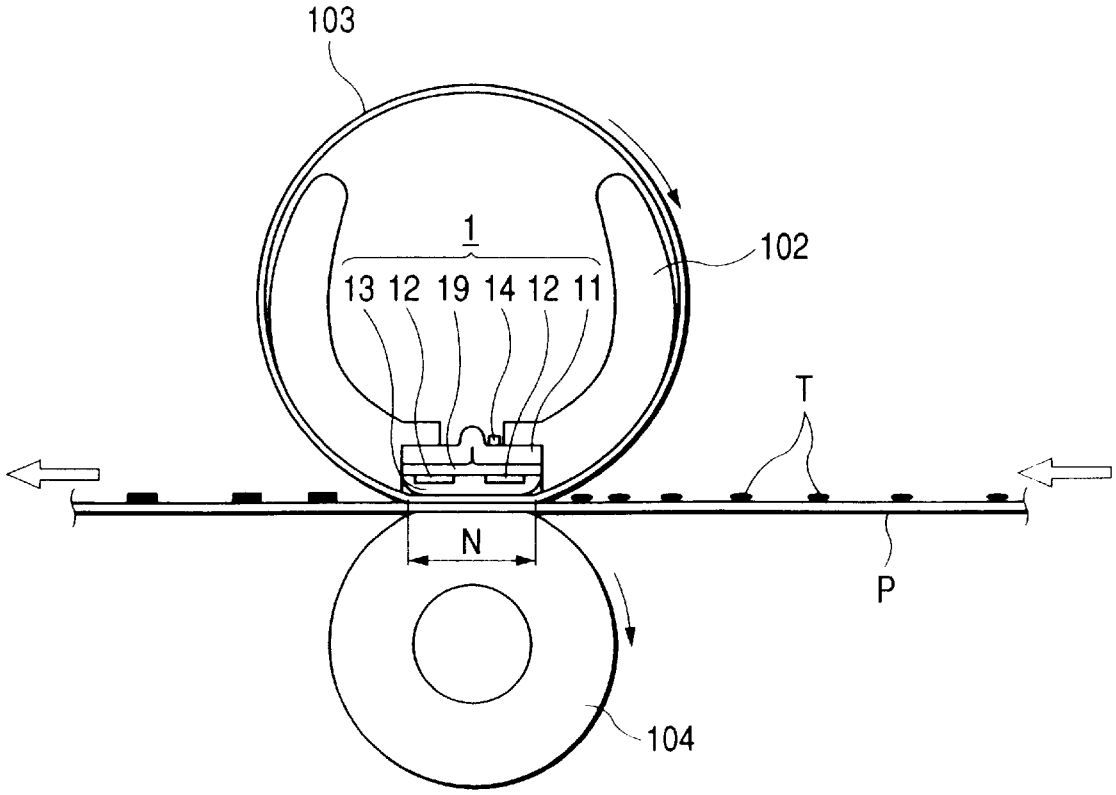
FIG. 10 a diagram showing an image heating apparatus according to an embodiment of the present invention.

Now, description will be made of an image heating apparatus according to the present invention which comprises a heating body. FIG. 10 is a schematic configurational diagram of the above described image heating apparatus.

In FIG. 10, reference numeral 1 denotes a heating member using a metal substrate, reference numeral 102 denotes a heating member holder in which the heating member 1 is fixed and held with a bottom up, reference numeral 103 denotes a heat-resistant film, reference numeral 104 denotes an elastic pressurizing roller which is in pressure contact with the heating member 1 with a heat-resistant film 103 interposed, thereby forming a fixing nip portion N as a heating portion having a predetermined width.

By driving means (not shown) or a rotating driving force of the pressurizing roller 104, the film 103 is conveyed through the fixing nip portion N at a predetermined speed in a direction indicated by an arrow while sliding on a surface of the heating member 1 in contact with the surface in the fixing nip portion N.

The recording material P as a member to be heated is introduced between the film 103 in the fixing nip portion N and the pressurizing roller 104 in a condition where the film 103 is conveyed at the predetermined speed and a temperature of the heating member 1 is controlled to a predetermined level, whereby the recording material P is sandwiched and conveyed through the fixing nip portion N together with the film 103 in close contact with a surface of the film 103, and the unfixed toner image T receives heat from the heating body 1 by way of the film 103 during the conveyance and is thermally fixed to a surface of the recording material.

After having passed through the fixing nip portion N, the recording material P is separated from the surface of the film 103 and conveyed for discharge.

Since the heating member 1 and the heat-resistant film 103 have relatively small heat capacities and the fixing nip portion N as a heating portion can be heated concentratedly by way of the film 103, the image heating apparatus is capable of having a quick start property and heating the toner image on demand in a power saving mode.

Since a temperature of the heating member 1 rises in a short time, the heating member 1 can be heated to a required temperature before the recording material reaches the fixing portion N even when the recording material is fed quickly. Moreover, the image heating apparatus does not heat the heating member 1 in a stand-by state, whereby the heating member does not raise a temperature in the image forming apparatus nor wastes energy.

Figure 1A:
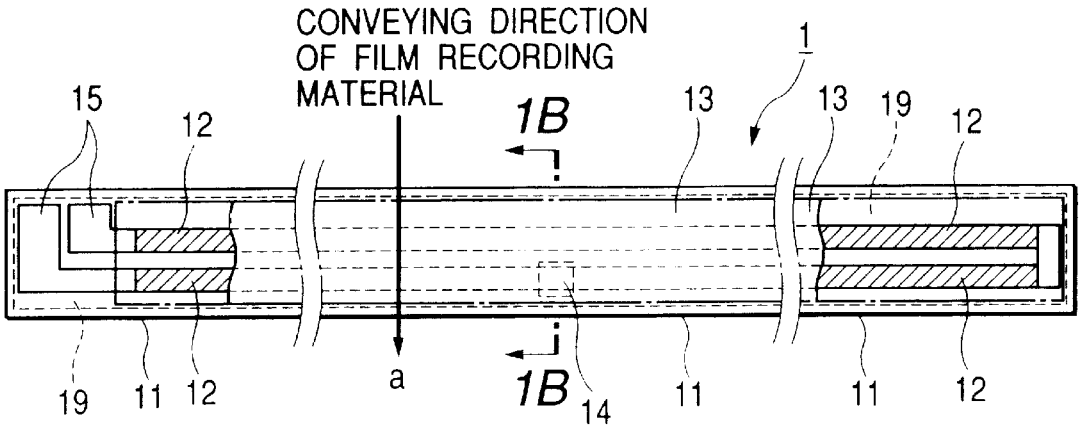
FIGS. 1A and 1B are diagrams showing a heater according to an embodiment of the present invention.
Figure 1B:
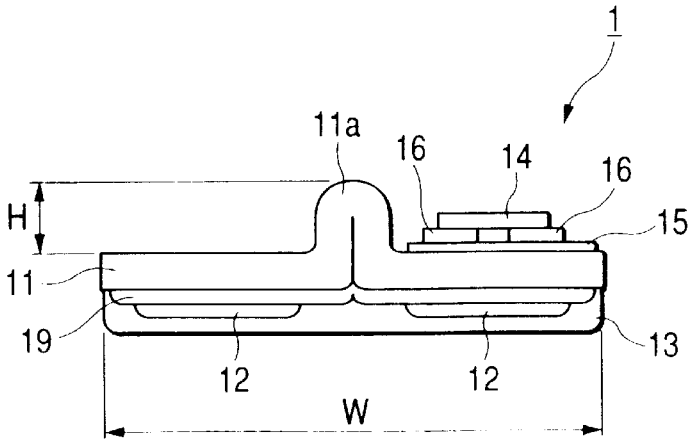

FIGS. 1A and 1B are sectional views of the heating member 1.

In FIGS. 1A and 1B, reference numeral 11 denotes an elongated substrate made of a metal such as stainless steel, an insulating glass layer 19 is formed on a surface of the substrate 11 as an electrically insulating layer, a heating resistor 12 is patterned on the insulating glass layer 19 by silk screening a paste material for electric resistor materials such as silver palladium (Ag/Pd), $RuO_2$, $Ta_2N$ or the like, and a glass coat layer 13 is formed over the heating resistor 12 as an electrically insulating surface protective layer.

Describing in detail, the substrate 11 is shaped by pressing (bending) a stainless steel plate 0.6 mm thick by 230 mm long so as to have a T sectional shape or form a rib 11*a* which is a convex portion (bent portion) in a longitudinal direction of the substrate as shown in FIG. 1B. When the rib 11*a* is formed to obtain a rigid structure, the substrate 11 has rigidity in the longitudinal direction even though the substrate is made of a thin plate having a small heat capacity. In this embodiment wherein a heater has a width W of 7 mm and the rib has a height H of 1 mm after completion of the heating member, the bending which enhances a heat capacity 30% allows rigidity to be enhanced approximately 10 times as high. The rib is formed on a surface of the substrate on a side opposite to the film.

The insulating glass layer 19 is formed by thick-film printing and calcined as the insulating layer on the bent substrate. Though the insulating glass layer 19 is heated to a temperature on the order of approximately 800 degrees at a step of calcination, the substrate which is bent so as to have the rib shape as in the embodiment is scarcely warped in contrast to a substrate made of a planar plate having a thickness on the order of 0.6 mm which is remarkably warped at a cooled time due to a difference in thermal expansion between the insulating glass layer 19 and the substrate 11.

Furthermore, the heating resistor 12 is printed and calcined on the insulating glass layer 19 so as to have a shape turned back in a longitudinal direction of the heating member, and then the glass coat layer 13 is printed and calcined so as to cover the heating resistor 12 as the surface protective layer. Though the insulating glass layer 19 and the glass coat layer 13 are shown separately in FIGS. 1A and 1B for convenience of description, these layers may be an identical glass layer, which allows the surface glass coat layer 13 to be fused with the lower insulating glass layer 19 which has been previously printed at a calcination time, thereby providing a merit to eliminate an interface, enclosing the heating resistor 12 with glass and enhancing an insulating property.

Figure 2:
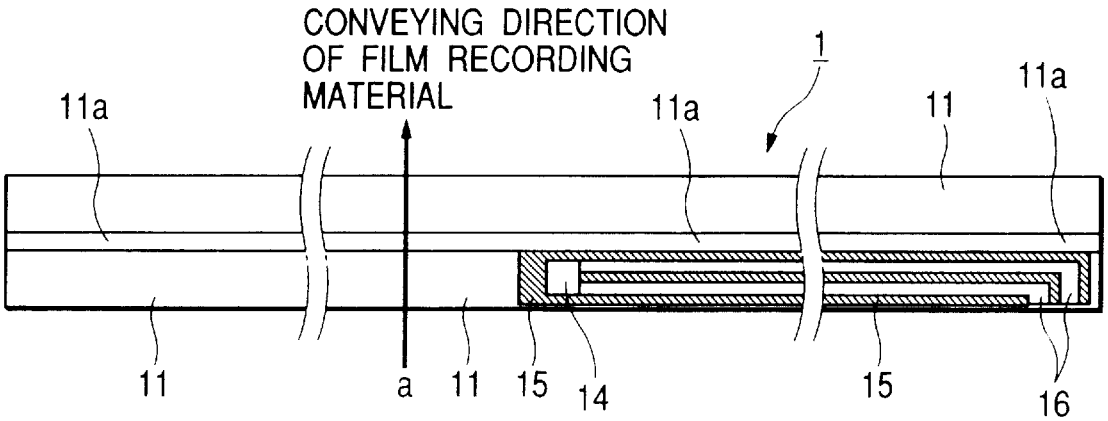
FIG. 2 is a rear view of the heater.

FIG. 2 shows a rear surface of the heating member 1 according to this embodiment. In FIG. 2, reference numeral 14 denotes a thermistor functioning as a temperature detecting element which is connected by DC patterns 16 to a point to be in contact with a connector (not shown). Reference numeral 15 denotes a glass layer for electrically insulating these DC line parts from a substrate made of stainless steel.

The heating member which has the above described configuration has a function equivalent to that of a conventional heating body using a ceramic such as alumina and can easily substitute for the conventional one.

Speaking of thermal strength, the conventional heating member made of alumina was ruptured by a thermal stress at an eighth heating treatment when a heat treatment and cooling of a recording material overlapped to a thickness on the order of 5 mm were repeated while controlling a temperature of a fixing device operating at a process speed of 60 mm/sec to 195° C., whereas the heating member according to this embodiment was not ruptured or broken even after the heating treatment and cooling were repeated twenty times.

When a substrate made of a planar plate of stainless steel 0.6 mm thick was used in combination with a glass layer having a thickness on the order of approximately 100 $\mu$m which served as the insulating glass layer 19 and the glass coat layer 4 provided as the surface protective layer, the conventional heating member was warped on the order of approximately 30 mm in a middle portion with a glass-coated side convex when warping was remarkable, whereas the heating member according to this embodiment was warped on the order of approximately 2 to 3 mm. Accordingly, the heating member could easily be assembled without being bonded to the heating member holder 2 and was not swollen so remarkably as to injure the heat-resistant film while the film is not pressed between the pressurizing roller and the heating member. Furthermore, the heating member was capable of preventing uneven heating in a longitudinal direction of the heating member.

Speaking of a quick start property which is a remarkable characteristic and a merit of the film heating type image forming apparatus, rising was compared among three kinds of heating members which used a substrate made of alumina 0.6 mm thick, a substrate made of a planar plate of stainless steel 0.6 mm thick and the shape according to the present invention having the rib 11*a* on a rear surface respectively with electric power to be supplied to the heating member set at 500 W: results being that the quick start property was remarkably different dependently on heat capacities and heat insulating properties of pressuring rollers, and when an identical pressurizing roller was used, a time required to reach a controlled temperature of 195° C. from room temperature (23° C.) was 5.3 seconds for the heating body using the substrate made of alumina, 6.0 seconds for the heating body using the substrate of the planar plate of stainless steel and 6.2 seconds for the heating body having the rib 11*a* which exhibited a slightly slow quick start property but could maintain a sufficient quickness without degrading a quick start property so remarkably.

Though the stainless steel which is shaped relatively easily and inexpensive was used in the embodiment, another metal such as copper or aluminium which has a high electrical conductivity poses no problem.

Figure 3:
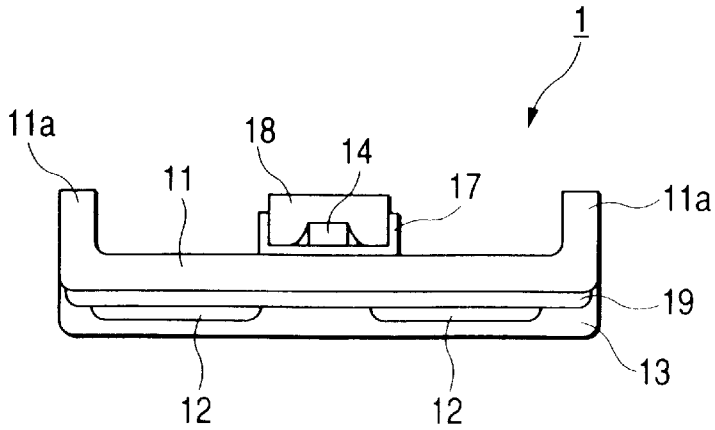
FIG. 3 is a side view of a heater according to another embodiment.

FIG. 3 is a sectional view of a heating member 1 according to another embodiment.

In this embodiment, ribs 11*a* are formed by bending both ends in a width direction of a substrate 11 on a side opposite to a heating surface (on a side of a film) so that the substrate 11 has a U sectional shape as shown in FIG. 3. Components which are similar to those in the above described embodiment are denoted by the same reference numerals and not described again.

This embodiment not only provides effects which are similar to those of the above described embodiment but also enhances freedom in disposing the temperature detecting element 14 on the rear surface of the heating member 1. That is, this embodiment enhances positional freedom, or permits disposing the temperature detecting element 14 at a location right behind the heating resistor 12 or a location a little downstream in a recording material conveying direction and freedom in shape of the temperature detecting element 14, or permits not disposing the temperature detecting element 14 directly on the rear surface of the heating body 1 but insulating the temperature detecting element 14 with a heat-resistant tape 17 and disposing the element on the rear surface of the heating body 1 under a pressure with an elastic member 18 as shown in FIG. 3.

Figure 4A:
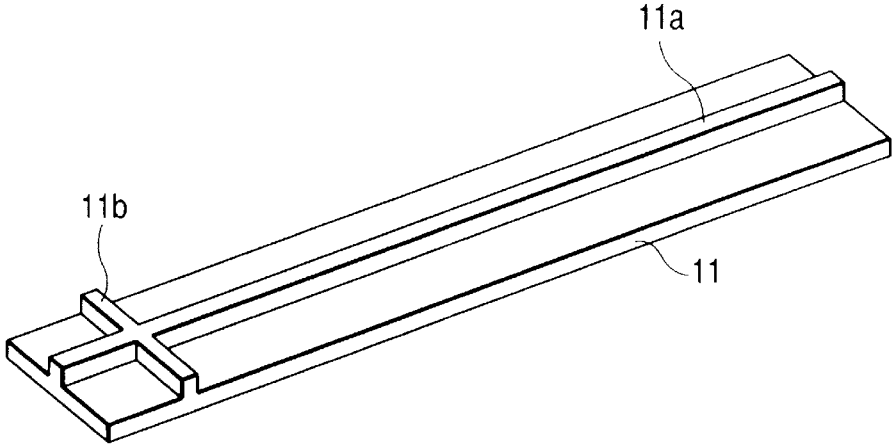
FIGS. 4A, 4B and 4C are diagrams showing a heater according to another embodiment.
Figure 4B:
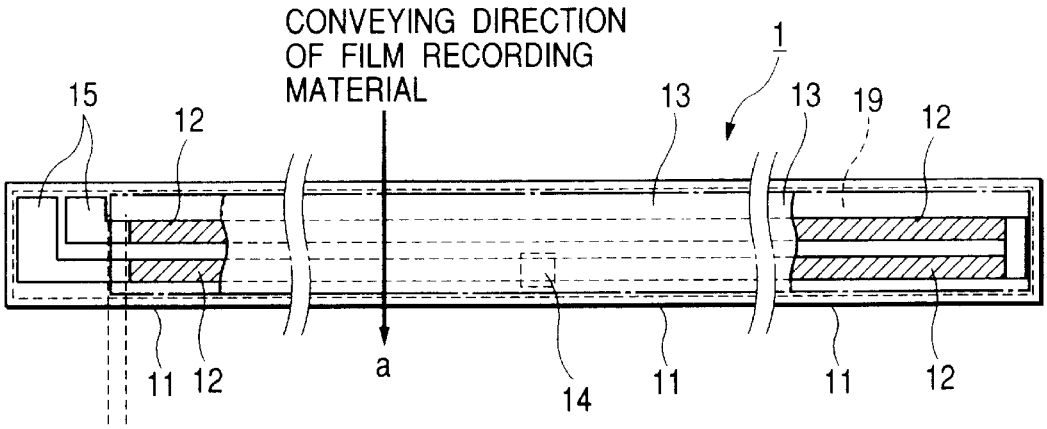
Figure 4C:
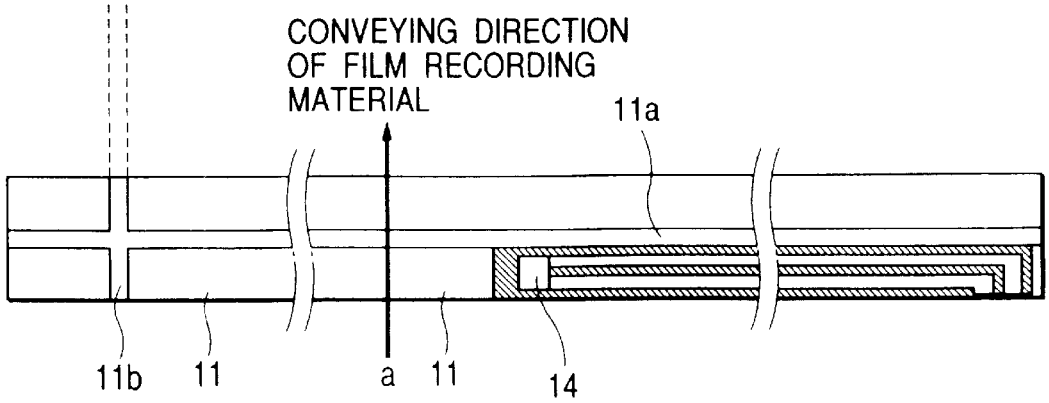

FIG. 4A is a perspective view of a rear surface of a substrate 11 composing a heating member 1 according to another embodiment, FIG. 4B is a partially cut diagram of a surface of the heating member 1 and FIG. 4C is a diagram of the rear surface.

The substrate 11 of a heating member 1 used in this embodiment is shaped by casting aluminium. Speaking of a shape, a rib 11*a* having a height of 0.7 mm is disposed in a longitudinal direction of the heating body 1 and a rib 11*b* having the same height of 0.7 mm is formed at an end on a side of the AC contacts 15 in a direction perpendicular to the above described rib 11*a* on a plate having a basic thickness of 0.8 mm. The heating resistor 12, the temperature detecting element 14 or the like which remain the same will not be described again.

Described in detail, the rib 11*a* in the longitudinal direction enhances rigidity of the heating member 1 as in the above described embodiment, thereby being capable of preventing warping due to a difference in thermal expansion between a metal and glass. On the other hand, the rib 11*b* in the width direction (in a direction of a shorter side of the substrate) perpendicular to the above described rib portion is longer than the heating resistor 12 on the surface of the heating member 1, outside a heating area and inside the AC contacts 15 on the surface in the longitudinal direction.

Figure 5A:
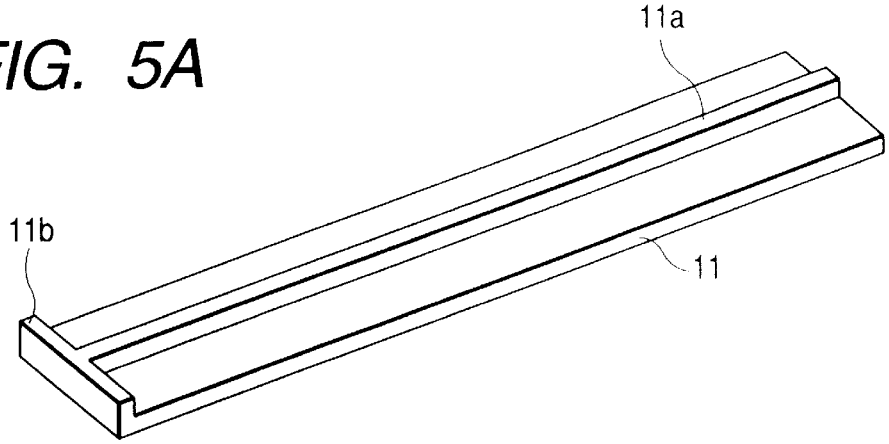
FIGS. 5A, 5B and 5C are perspective views showing another configuration example of a heater substrate.

The rib 11*b* formed on the substrate 11 prevents the heating member from being warped in the width direction. Though the substrate 11 is shorter in the width direction than in the longitudinal direction and warped less in the width direction, each of the AC contacts 15 which are formed by thick film printing may be locally subjected to a strong force and cut by the electrodes of the connector when the substrate is warped as a stage to insert the connector into the AC contacts. When a high current is supplied to the cut contacts 15, the contacts may be burnt out, thereby causing improper electrical conduction and a trouble in the image heating apparatus. The ribs are therefore disposed in the vicinities of an insert portion of the connector to maintain rigidity and flatness of the substrate, thereby preventing poor contact from being caused due to cutting of the contacts. The rib 11*b* in the width direction may be disposed outside the contacts 15 as shown in FIG. 5A.

Figure 5B:
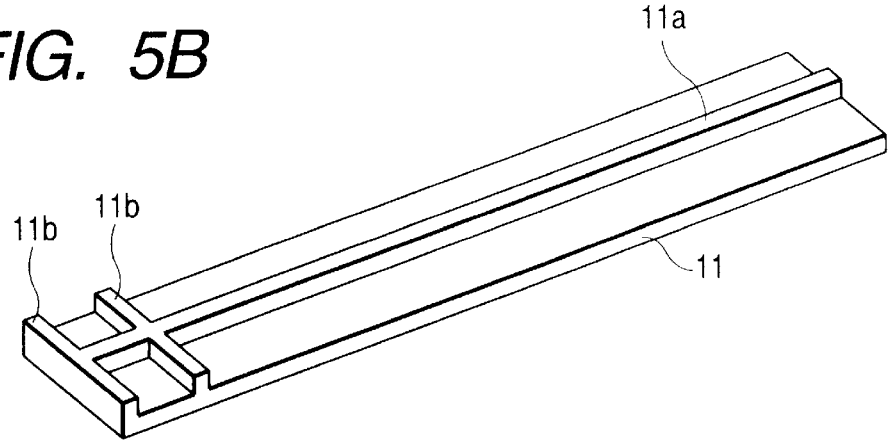
Figure 5C:
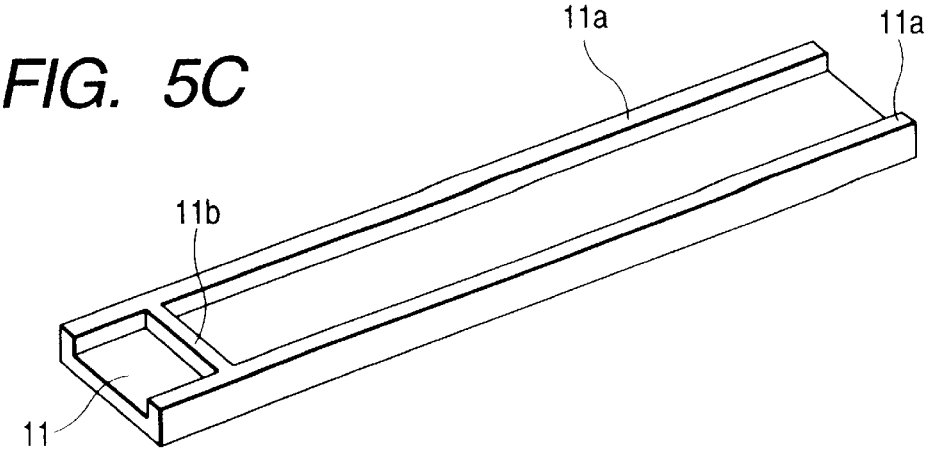

Furthermore, the rib 11*b* may be disposed on both sides of the contacts 15 as shown in FIG. 5B. Moreover, the rib 11*a* in the longitudinal direction may be disposed at both ends in the width direction as shown in FIG. 5C.

Figure 6A:
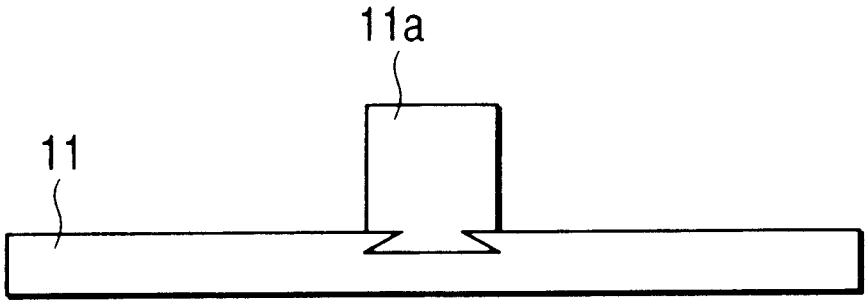
FIGS. 6A and 6B are side views showing another configuration example of the heater substrate.
Figure 6B:
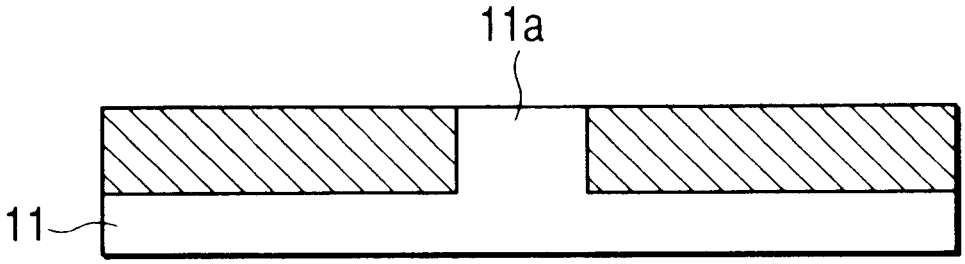

Though the ribs (convex portions) are formed by bending or casting in the above described embodiment, this is not limitative and as far as convex portions can be formed it is possible to adopt any means such as formation of the ribs 11*a* and 11*b* by welding another material to the planar substrate 11, fitting of fitting portions formed on the substrate 11 and the rib 11*a* as shown in FIG. 6A or formation of the rib 11*a* by cutting off unnecessary portions (slashed portions) as shown in FIG. 6B.

Figure 7:
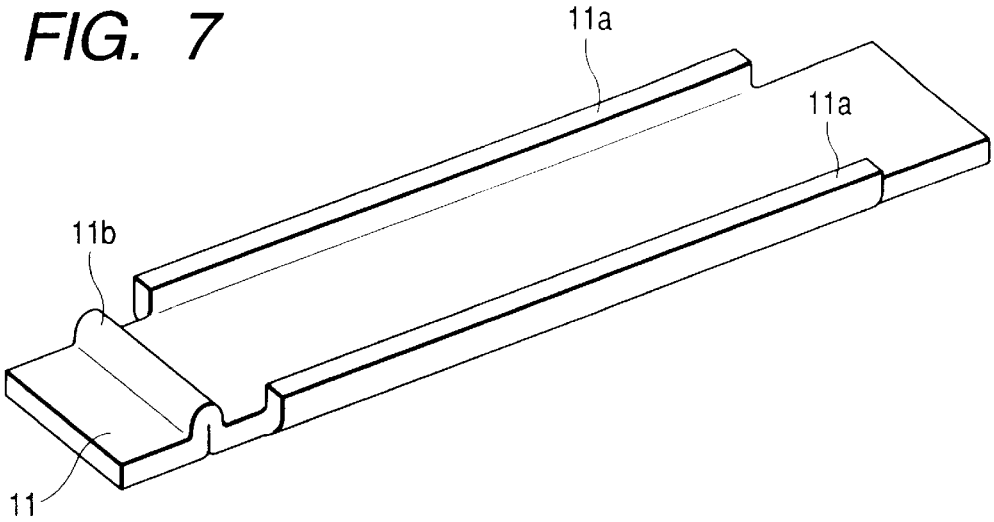
FIG. 7 is a perspective view showing another configuration example of the heater substrate.

Furthermore, it is not always necessary to form the rib 11*a* or 11*b* over an entire range of the substrate 11 in the longitudinal direction or the width direction and the rib may be disposed partially in the longitudinal direction to such a degree that the warping of the material is allowable. In FIG. 7, the ribs 11*a* are formed by bending within a predetermined range in a middle portion except ends in the longitudinal direction and the rib 11*b* is disposed in the vicinity of the contacts 15.

Figure 8A:
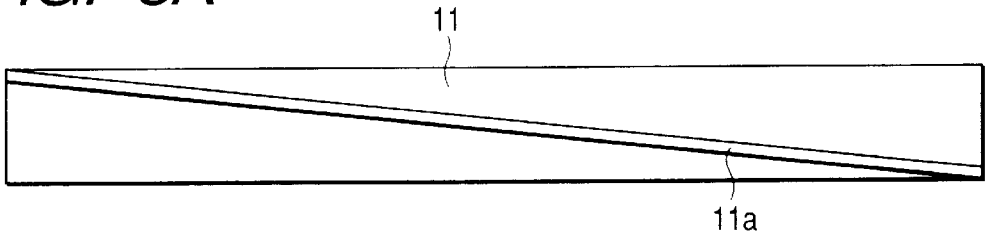
FIGS. 8A, 8B and 8C are rear views showing another configuration example of the heater substrate.
Figure 8B:
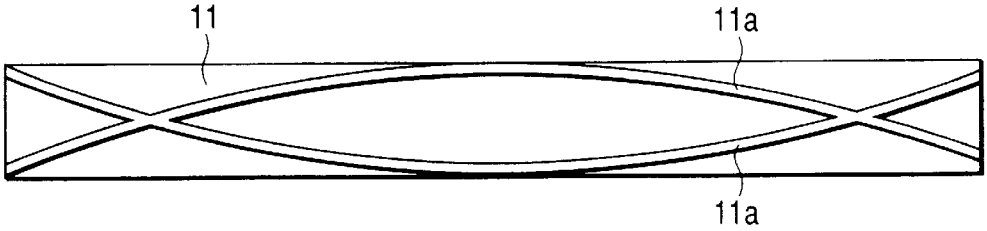
Figure 8C:
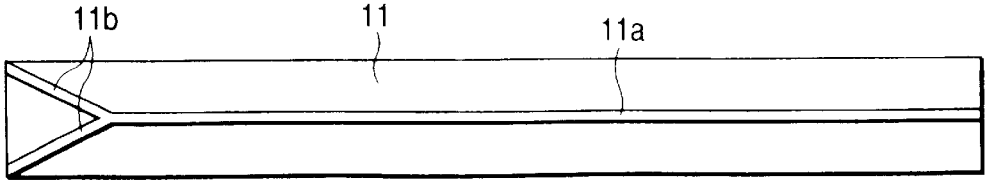
Figure 9:
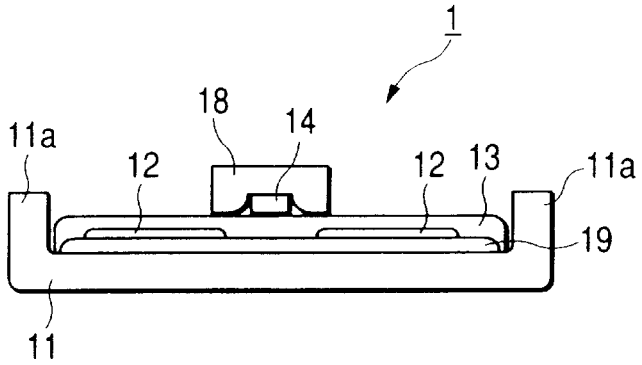
FIG. 9 is a side view of a heater according to another embodiment.

It is not necessary to form the rib 11*a* strictly in parallel with the longitudinal direction so far as the rib is configured to enhance rigidity of the substrate 11 and the rib 11*a* may be formed on a diagonal line as shown in FIG. 8A or the ribs 11*a* may be formed in shapes of curved lines as shown in FIG. 8B. Similarly, it is not necessary to dispose the rib 11*b* strictly in parallel with the direction of the shorter side and the ribs 11*b* may have a configuration serving also as a portion of the rib 11*a* as shown in FIG. 8C so far as it can obtain such a rigidity as to ignore the warping at the contacts 15.

Though the above described heating member has a configuration wherein the heating resistor 12 is disposed on a surface of the above described heating member which heats the member to be heated and the convex portions are disposed on a surface on an opposite side, it is possible to adopt a configuration wherein the heating resistor 12 is disposed on the surface opposite to the surface which heats the member to be heated and the convex portions are disposed on the surface which heats the member to be heated.

The above described embodiment which uses the metal substrate 11 as the heating member 1 facilitates to uniformalize a temperature distribution in the longitudinal direction of the heating member, moderates temperature rise in the no-paper passage portions when paper having a small size or thick paper passes and prevents offset at high temperatures. Furthermore, the embodiment prevents warping of the heating member, thereby facilitating to assemble the heating member and preventing the breakage of the heating resistor in the heating member and injury of a film due to remarkable warping.

Now, description will be made of another embodiment which is configured to prevent a film from being injured by an edge of a heater while enhancing rigidity of the heater.

Figure 13:
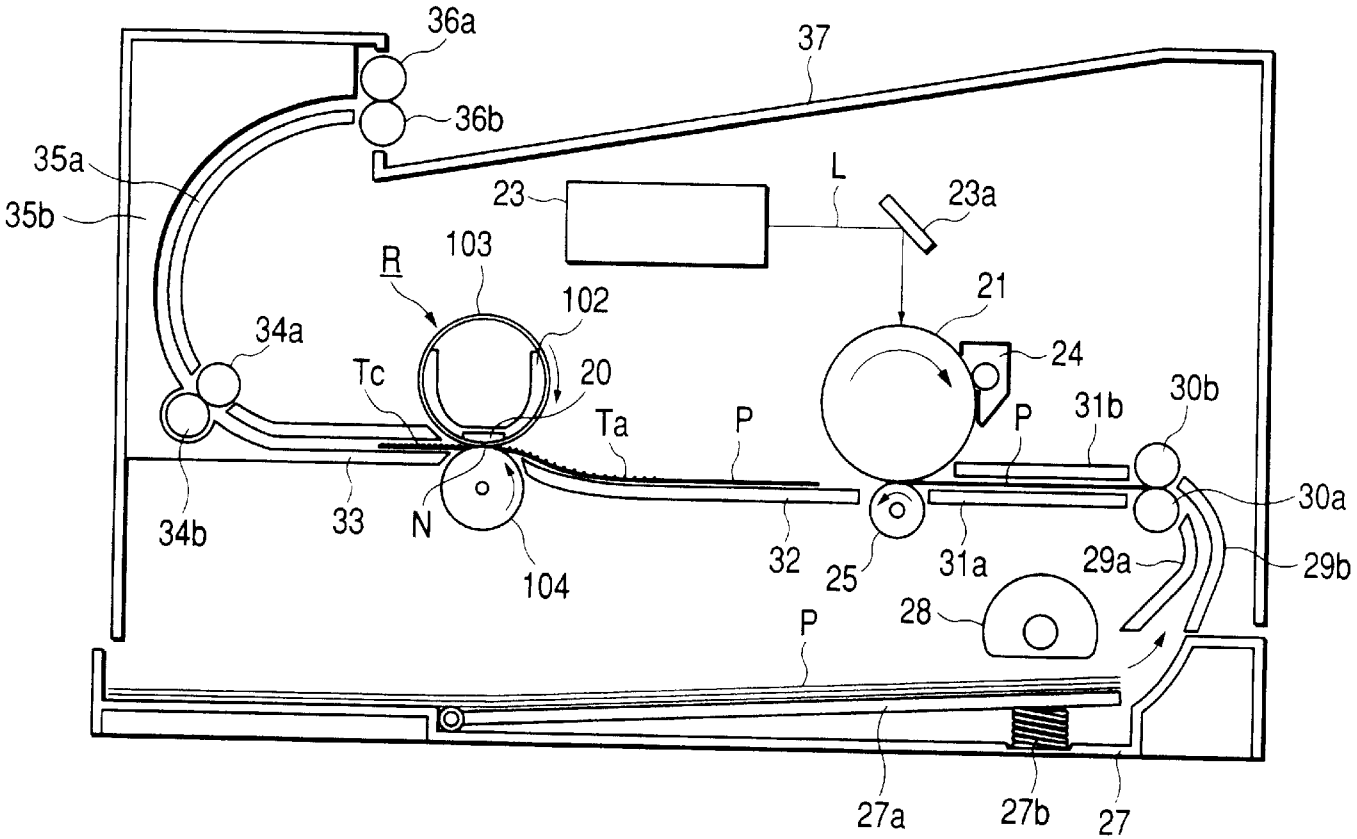
FIG. 13 is a diagram of another image forming apparatus to which the present invention is applicable.

FIG. 13 shows schematic configuration of an example of image forming apparatus. The image forming apparatus taken as the example is a laser beam printer utilizing a transfer type electrophotography process.

Upon reception of an image formation start signal, an electrophotographic photosensitive body (hereinafter referred to as a drum) 21 is rotatingly driven in a clockwise direction indicated by an arrow and a surface of the rotating drum 21 is uniformly charged to predetermined polarity and potential by a charger (not shown).

To the charged surface of the drum 21, a laser beam L which is modulated in correspondence to time series electric digital image signals of image information are output from a laser scanner 23 and scanning exposure is performed by way of a mirror 23, whereby an electrostatic latent image is consecutively formed on the surface of the drum 21 in correspondence to the image information. The latent image is then visualized as a toner image by a developing apparatus 24.

On the other hand, a recording material P is fed from a feed cassette 27 by a feed roller 28 and conveyed to a pair of registration rollers 30*a* and 30*b* through a sheet conveying path formed by U turn guides 29*a* and 29*b*. Then, the recording material P is conveyed between conveying guides 31*a* and 31*b* in synchronization with a rotation of the drum 21 and fed to a transfer location composed by the drum 21 and a transferring roller 25 which is pressed and opposed to the drum 21. At the transfer location, a toner image Ta is consecutively transferred from the surface of the drum 21 to a surface of the recording material P.

After passing through the transfer location, the recording material P is separated from the surface of the drum 21 and introduced along a guide 32 into a fixing apparatus R, where an unfixed toner image Ta is heated and fixed as a fixed image Tc.

Then, the recording material P is conveyed between a pair of conveying rollers 34*a* and 34*b* and a pair of guides 35*a* and 35*b*, and output by a pair of discharge rollers 36*a* and 36*b* as image formed object (print) into a discharge tray 37.

Disposed in the feed cassette 27 is an intermediate bottom plate which swings up and down as well as a spring member which urges the intermediate bottom plate upward.

Figure 14:
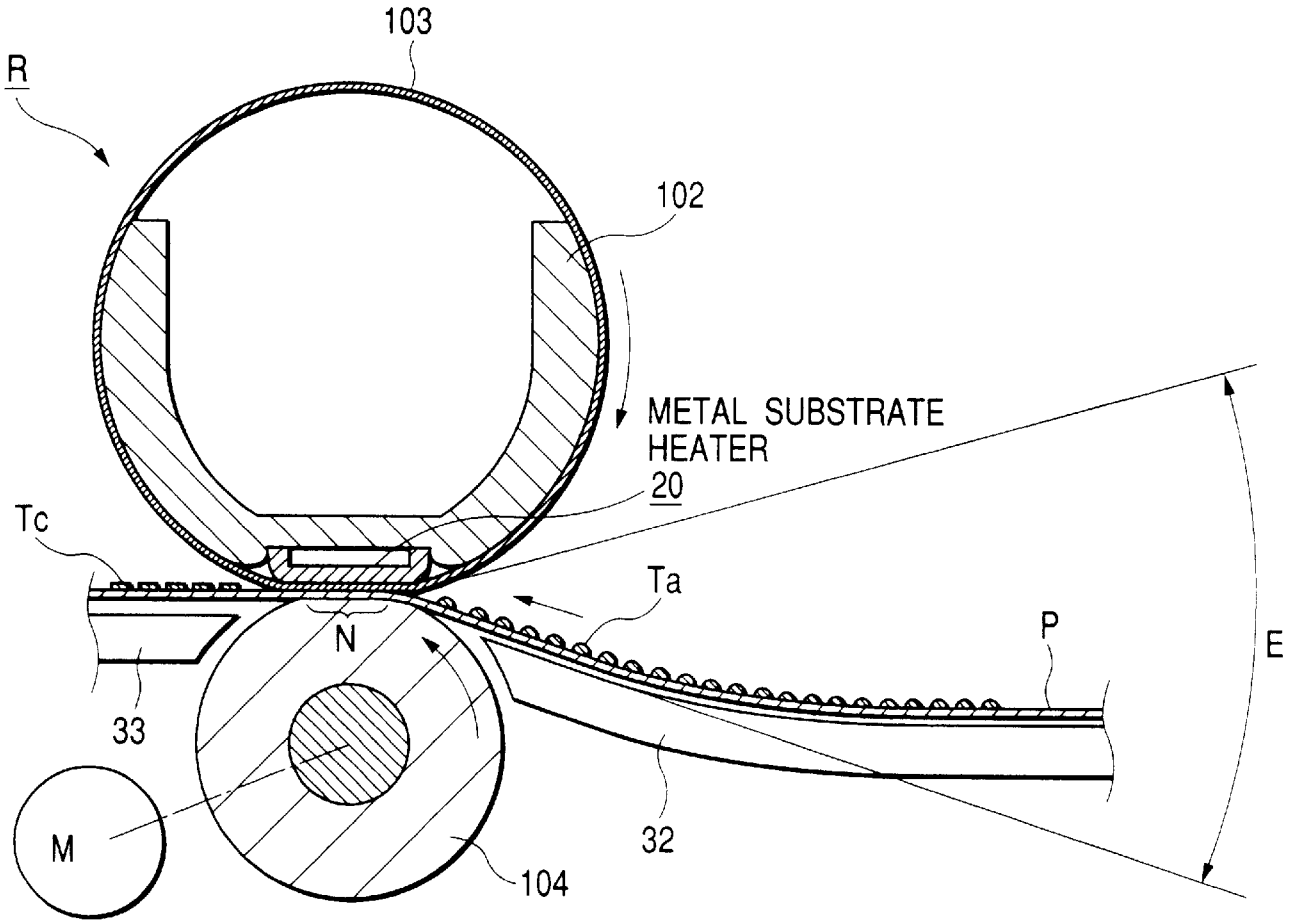
FIG. 14 is a diagram of an image heating apparatus according to another embodiment of the present invention.
Figure 15:
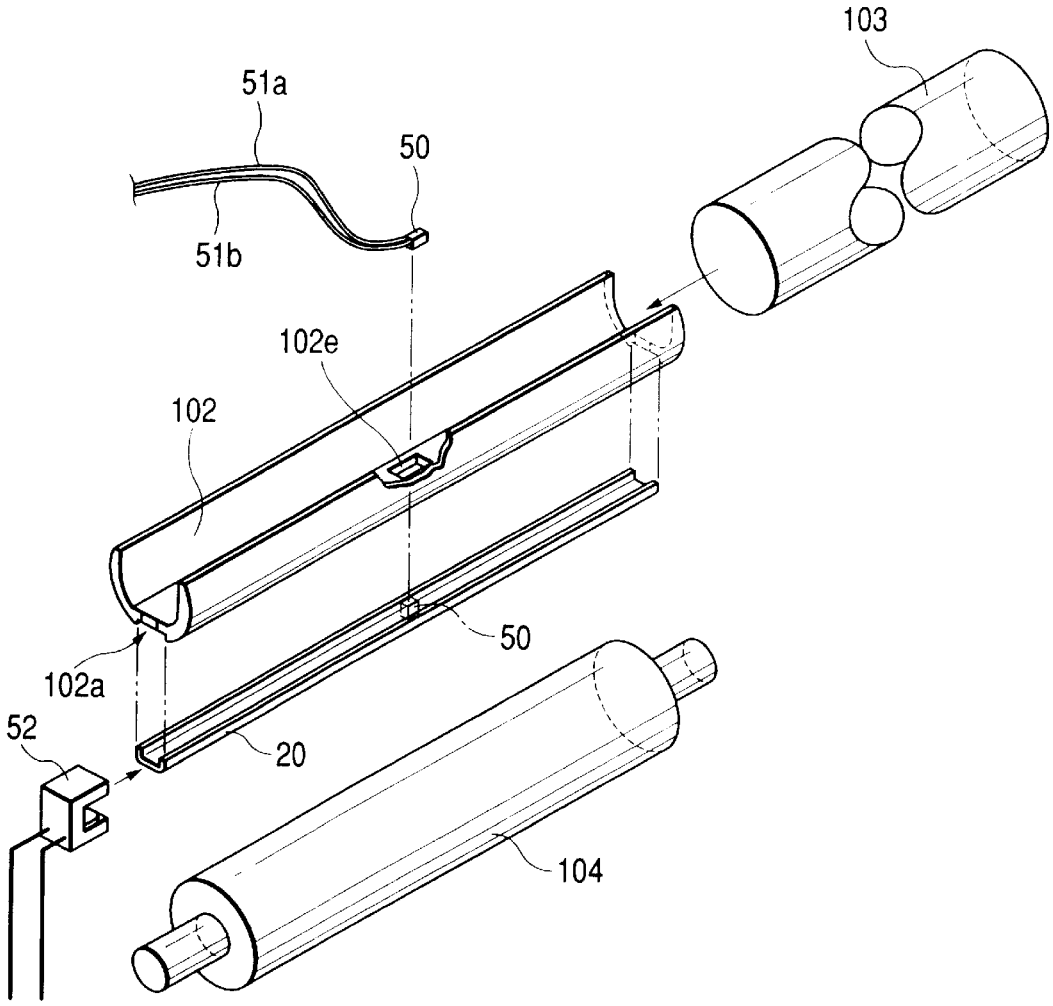
FIG. 15 is an exploded perspective view of the image heating apparatus.
Figure 16:
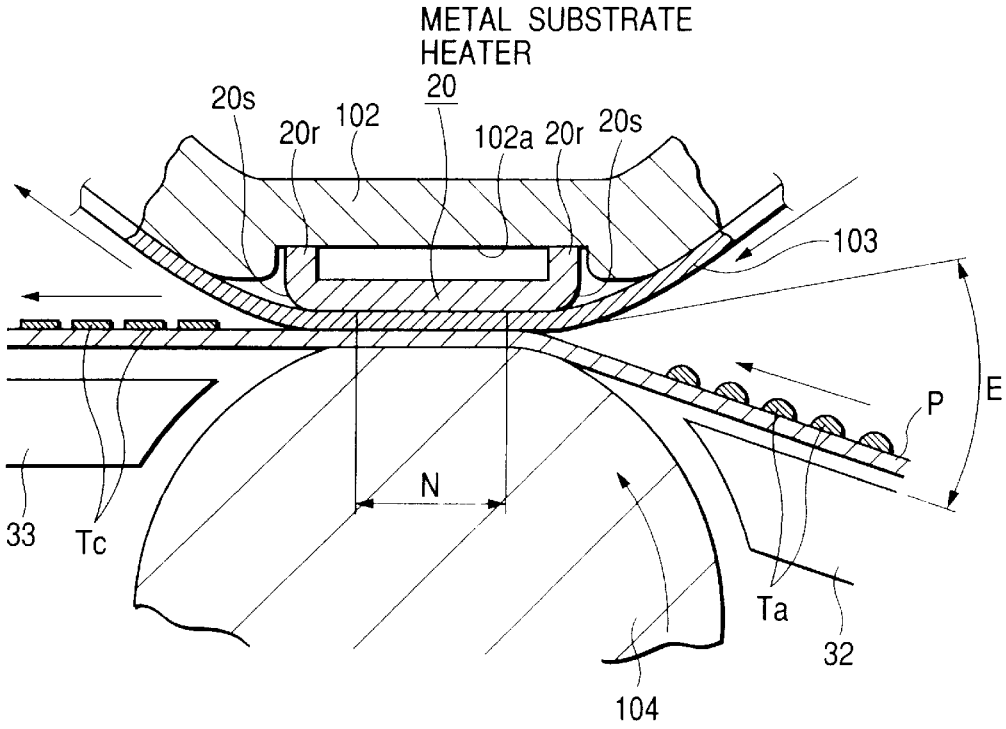
FIG. 16 is an enlarged view of a nip portion.

The fixing apparatus R is a film heating type heating apparatus according to the present invention. FIG. 14 is a cross sectional view of main members, FIG. 15 is a partially cut exploded perspective view of the main members and FIG. 16 is an enlarged view of a fixing nip portion.

Like the above described fixing apparatus shown in FIG. 10, the film heating type fixing apparatus R is a pressuring roller driving tensionless type apparatus using a cylindrical fixing film 103, and component members and parts which are common to the fixing apparatus shown in FIG. 10 will be denoted by the same reference numerals and will not be described in particular.

A heater 20 which functions as a heating member is not a ceramic heater but a metal substrate heater which a configuration wherein the heater comprises a resistor layer which generates heat when power is supplied to a metal substrate by way of an insulating layer, and ends of an upstream edge and a downstream edge in a moving direction of a film are bent on a side opposite to the above described film. This metal substrate heater 20 will be described later.

A heater holder 102 which functions as member for supporting a heating member is a conduit type member having a nearly semicircular sectional shape which is made of a liquid crystal polymer, phenolic resin, PPS, PEEK or the like and the metal substrate heater 20 is fitted and supported in a groove 102*a* formed in a bottom surface of the heater holder 102 in a longitudinal direction of the heater holder.

A fixing film 103 is a cylindrical film material and fitted loose over the heater holder 102 which supports the above described metal substrate heater 20. Used in this example is a fixing film which is made of polyimide excellent in a thermal conductivity, heat resistance and a releasability and coated with fluoroplastic.

The fixing film 103 is a member which has a small heat capacity and configured as a film having a thickness not larger than 100 μm and made of polyimide, polyamide imide, PEEK, PES, PPS, PFA, PTFE, FEP or the like having heat resistance and thermoplasticity to enable quick start. In order to compose a heating fixing apparatus having a long service life, the fixing film 103 must have a thickness not smaller than 20 μm so as to have sufficient strength and an excellent durability. Accordingly, a thickness optimum for the fixing film is not smaller than 20 μm and not larger than 100 μm. In order to prevent offset and maintain a separating property of the recording material P, a surface layer of the fixing film 103 is coated with a mixture or a single component of a heat-resistant resin having a favorable releasability such as PFA, PTFE, FEP, silicone resin or the like.

An elastic pressurizing roller 104 functioning as a pressuring member is configured by a core metal and an elastic layer, for example, of heat-resistant rubber such as silicone rubber, fluororubber or expanded silicone rubber which is formed outside the core metal. A releasing layer of PFA, PTFE, FEP or the like may be formed outside the elastic layer.

In order to rotate the fixing film 103 smoothly with a low torque by driving the film with the elastic pressurizing roller 104, it is necessary to keep low frictional resistance among the metal substrate heater 20, the heater holder 102 and the fixing film 103. For this reason, a small amount of a lubricating agent such as a heat-resistant grease is present among the metal substrate heater 20, the heater holder 102 and the fixing film 103.

Figure 17:
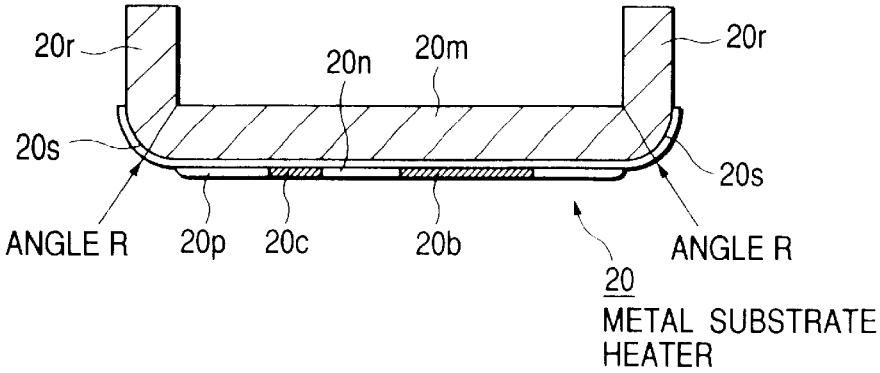
FIG. 17 is a side view of a heater.
Figure 18A:
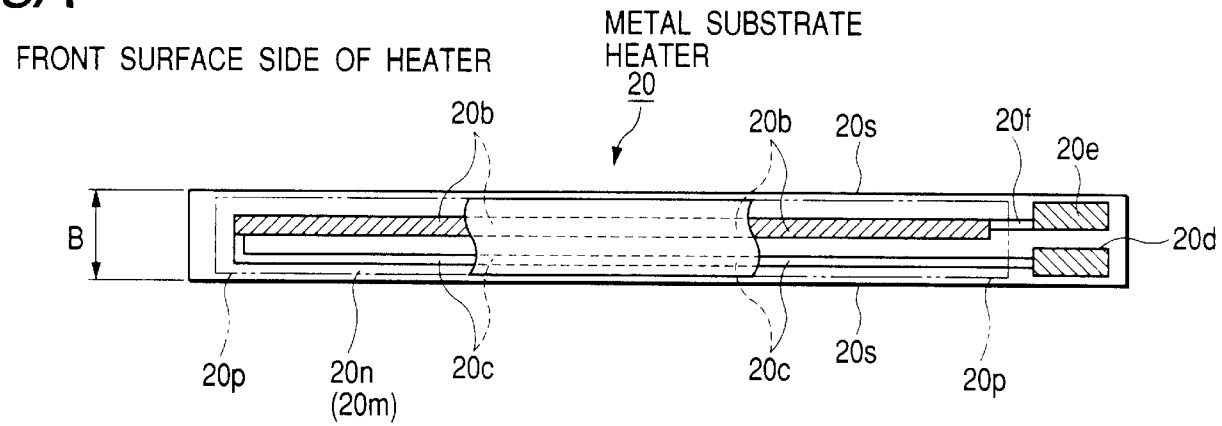
FIGS. 18A and 18B are plan views of the heater.
Figure 18B:
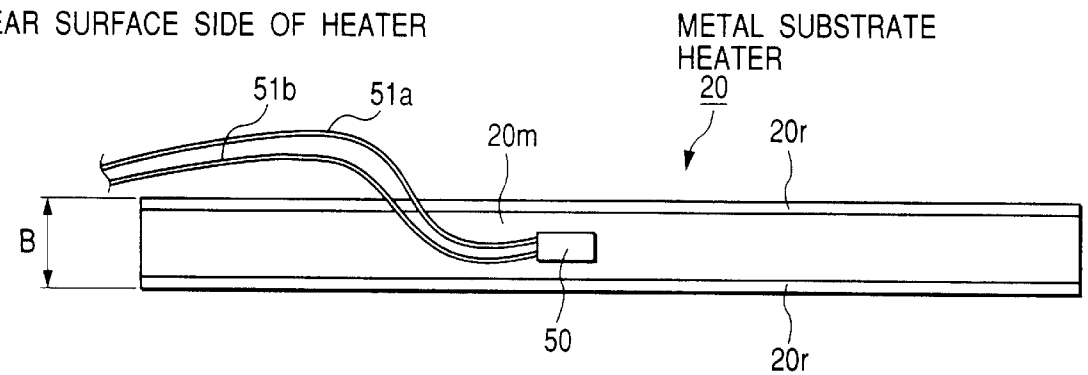

FIG. 17 is an enlarged cross sectional view of the metal substrate heater 20, and FIGS. 18A and 18B are a partially cut plan view of a front surface of the above described heater and a plan view of a rear surface of the above described heater respectively.

Used as a heater substrate 20*m* of the metal substrate heater 20 in this example is a metal substrate which is pressed into a U shape in a cross section. Taking a surface of the substrate on a side of bent legs 20*r* and 20*r* and a surface of the substrate on an opposite side as a rear surface and a front surface respectively, the metal substrate heater 20 has a configuration wherein an insulating layer 20*n* is disposed on the front surface of the metal substrate, and a resistor layer 20*b* which generates heat when power is supplied, first and second conduction path patterns 20*c* and 20*f*, first and second electrode portion patterns 20*d* and 20*e*, and a surface protective layer 20*p* are formed on the insulating layer 20*n*.

More specifically, used as a material of the metal substrate 20*m* is a stainless steel (SUS) material 0.3 mm thick. An angle R of two bent portions 20*s* and 20*s* of the U shape in the cross section has a radius of 0.5 mm, and the metal substrate 20*m* as a whole has external dimensions 270 mm long by 7 mm wide by 2 mm high.

Disposed on the front surface of the metal substrate 20*m* is the insulating layer 20*n* coated with heat-resistant glass having a high insulating property, thereby electrically insulating the metal substrate 20*m* which is electrically conductive from the resistor layer 20*b*, the first and second electric conduction path patterns 20*c* and 20*f*, and the first and second electrode portion patterns 20*d* and 20*e*. The glass insulating layer 20*n* is 50 μm thick, and formed by printing a glass paste by screen printing or the like and calcining the glass paste.

The resistor layer 20*b* is formed on the insulating layer 20*n* along a longitudinal side of the substrate by coating, for example, a paste of an electrical resistor material (resistor paste) such as silver palladium (Ag/Pd) or $Ta_2$ in a pattern of an elongated belt, for example, 10 μm thick and 1 to 3 mm wide by screen printing and calcining the pattern.

The first electric conduction path pattern 20*c* is formed in a shape of an elongated belt on the insulating layer 20*n* nearly in parallel with the above described resistor pattern. The first and second electrode portion patterns 20*d* and 20*e* are formed on the insulating layer 20*n* side by side on a surface of an end in a longitudinal direction of the metal substrate 20*a*.

An end of the above described first electrical conduction path pattern 20*c* is extended so as to be continuous and conductive to the first electrode pattern 20*d*. Furthermore, an end of the resistor layer pattern 20*b* is conductive to the second electrode portion pattern 20*e* by way of the second electrical conduction path pattern 20*f*. The other end of the resistor layer pattern 20*b* is conductive to the other end of the electrical conduction path pattern 20*c*.

Accordingly, there are composed a series of electrical paths from the first electrode portion pattern 20*d* to the second electrode portion pattern 20*e* by way of the first electrical conduction path 20*c*, the resistor layer pattern 20*b* and the second electrical conduction path pattern 20*f* (an AC power supply path for the resistor layer pattern 20*b* hereinafter referred to as an AC line).

Each of the above described first and second electrode portion patterns 20*d*, 20*e* and the first and second electrical conduction path patterns 20*c*, 20*f* is formed by patterning a paste of an electrically conductive material such as Ag by screen printing or the like and calcining the paste.

The surface protective layer 20*p* is a heat-resistant glass layer having a thickness, for example, on the order of 10 μm. The protective layer 20*p* covers surface forming portions of the resistor layer pattern 20*b*, first and second electrical conduction path patterns 20*c* and 20*f*, except portions on which the first and second electrode portion patterns 20*d* and 20*e* are disposed, whereby the resistor layer pattern 20*b*, the first and second electrical conduction path patterns 20*c* and 20*f* are covered with the protective layer 20*p* and protected against abrasion or the like.

The above described metal substrate heater 20 is fitted and supported in the groove portion 102*a* disposed in the bottom surface of the heater holder 102 in the longitudinal direction in a condition where a front surface of the metal substrate heater 20 is set downside and exposed.

A power supply connector 52 on a side of a power supply circuit is disposed at an end on a side of the first and second electrode portion patterns 20*d* and 20*e* of the metal substrate heater 20, and two elastic electric contacts on a side of the above described connector are in a condition where the contacts are elastically in contact with the first and second electrode portion patterns 20*d* and 20*e*, whereby a power supply circuit (not shown) is electrically connected to the above described AC line on a side of the metal substrate heater 20.

Furthermore, a thermistor 50 functioning as a temperature detecting element is disposed in the vicinity of a middle of a rear surface of the metal substrate 20*m* so that the thermistor 50 is brought by a spring (not shown) into contact with the substrate 20*m* through a through hole 102*e* formed in the heater holder 102. Lead wires 51*a* and 51*b* are led from the thermistor 50 for electrical connection to a temperature control circuit (not shown) (a DC line).

When power is supplied from the power supply circuit to the AC line of the metal substrate heater 20, the resistor layer pattern 20*b* of the AC line generates heat from an overall length in the longitudinal direction, thereby rapidly raising a temperature of the metal substrate heater 20. Temperature rise of the metal substrate heater 20 is detected by the thermistor 50 disposed on a side of a rear surface of the heater and detected temperature information (a DC current) is fed back from the DC line to the temperature control circuit. The temperature control circuit controls power supplied from the power supply circuit to the resistor layer pattern 20*b* of the AC line so that a heater temperature detected by the thermistor 50 is kept at a predetermined nearly constant temperature (fixing temperature). That is, the metal substrate heater 20 is heated and controlled to the predetermined fixing temperature.

When the metal substrate heater 20 overruns, a thermal fuse (not shown) disposed in series with the AC line operates to emergently intercept the power supply to the heater.

Figure 19A:
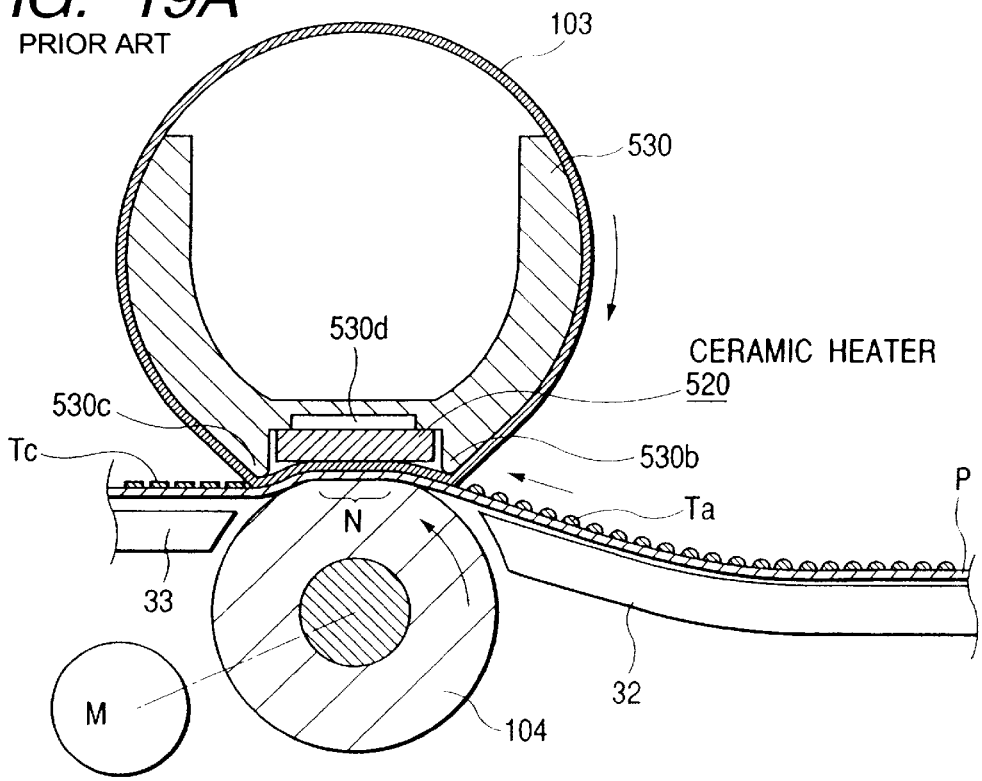
FIG. 19A PRIOR ART
FIGS. 19A and 19B are diagrams showing a conventional image heating apparatus.
Figure 19B:
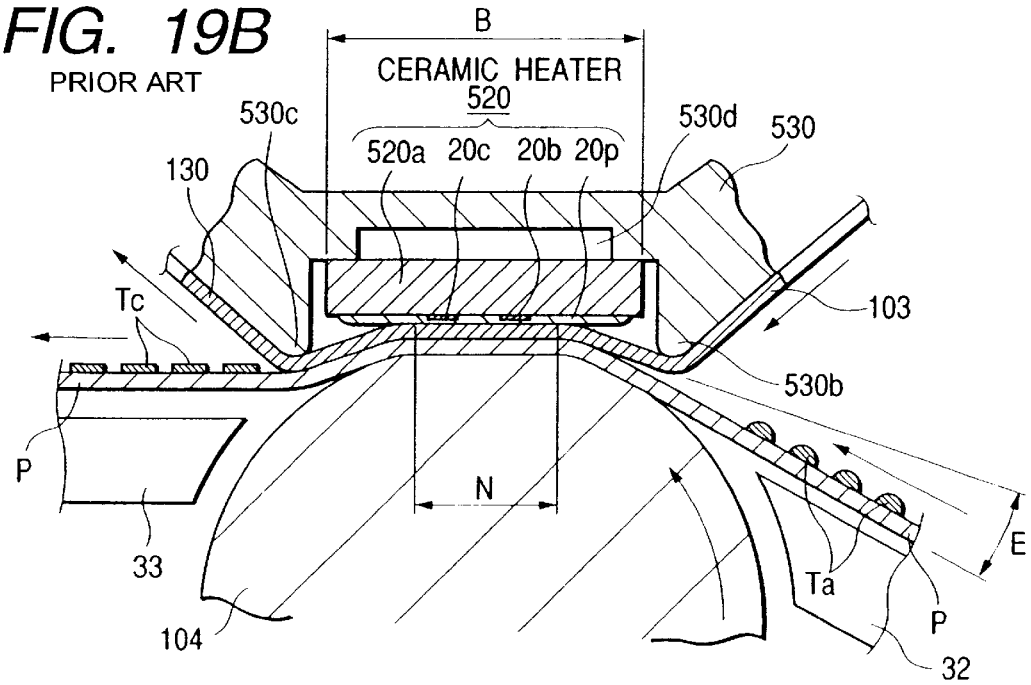
FIG. 19B PRIOR ART

The metal substrate heater 20 comprises the resistor layer 20*b* which generates heat when power is supplied to the metal substrate 20*m* by way of the insulating layer 20*n* and the ends at the upstream edge and the downstream edge in the film moving direction which are bent on the side opposite to the film as described above, whereby the fixing film 103 can slide smoothly along the angle portion 20*s* of the above described heater 20 even when the fixing film 103 comes in contact with the angle portion 20*s* since the above described corner portion (angle portion) 20*s* is rounded. Unlike a conventional ceramic heater 520 shown in FIGS. 19A and 19B, the metal substrate heater 20 allows the fixing film 103 to slide along the angle portion of the heater 20*s* since resistance is sufficiently low even when the angle portion 20*s* of the metal substrate 20*m* slides on an inside surface of the fixing film 103.

Accordingly, the fixing film 103 slides smoothly along the angle portion 20*s* which are formed by bending the ends of the metal substrate 20*m* and is guided in a locus which is close to a true circle without protrusions 530*b* and 530*c* of a heater holder 530 which are formed in the conventional image heating apparatus (FIGS. 19A and 19B) using a ceramic heater 520 comprising a ceramic substrate 520*a* (FIG. 14). As a result, the embodiment is capable of keeping rotational resistance of the fixing film 103 lower than that in the conventional image forming apparatus, thereby preventing image disturbance which may be caused due to slip between the recording material P and the fixing film 103.

Furthermore, the embodiment eliminates a necessity of the protrusion 530*c* downstream the heater holder 530, thereby allowing the fixing film 103 to be conveyed and guided in parallel with the fixing nip portion N and linearly even right downstream the fixing nip portion N so that the recording material P can be conveyed in parallel with the fixing hip portion N and linearly. Accordingly, the embodiment moderates a tendency to curl a leading end of the recording material P which is problematic in the conventional image forming apparatus.

Furthermore, the embodiment eliminates a necessity of the protrusion 530*b* upstream the heater holder 530, thereby making it possible to reserve a wider entrance E for the fixing nip portion N and lead the recording material P more smoothly into the nip portion. Smooth leading of the recording material P into the nip portion lowers a possibility of occurrence of problems such as paper clogging and paper wrinkling.

Furthermore, since the metal substrate heater 20 comes into contact with the heater holder 102 at thick plate portions of the bent leg sides 20*r*, 20*r* and the bent leg sides 20*r*, 20*r* function as spacers which form an adiabatic space between the rear surface of the metal substrate heater 20 and the heater holder 102, a contact area between the metal substrate heater 20 and the heater holder is narrow and heat dissipation from the metal substrate heater 20 to the heater holder 102 is suppressed at a low level, thereby making it possible to supply heat energy to the fixing film 103 and the recording material P with a high efficiency. Since a space 530*d* which is reserved between the ceramic heater 520 and the heater holder 530 in the conventional image forming apparatus is unnecessary for the embodiment, the embodiment is free from an event that the heater falls into the space 530*d* between the heater and the heater holder even when the heater is fixed at a location deviated upstream or downstream.

Furthermore, the embodiment is capable of enhancing rigidity of the heater with the bent portions.

Figure 20A:
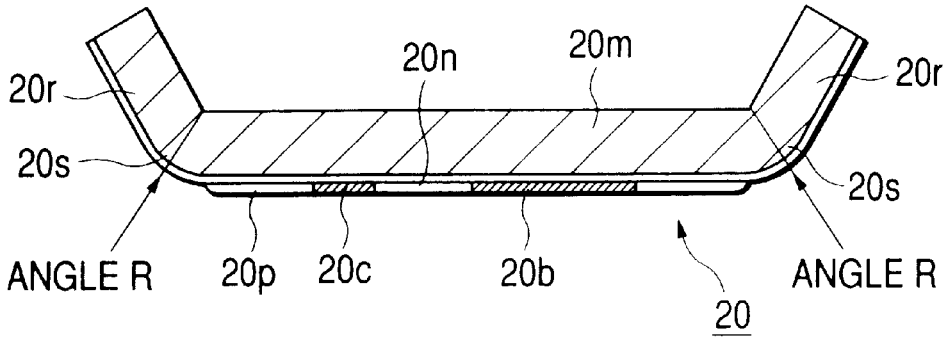
FIGS. 20A and 20B are side views of a heater according to another embodiment.
Figure 20B:
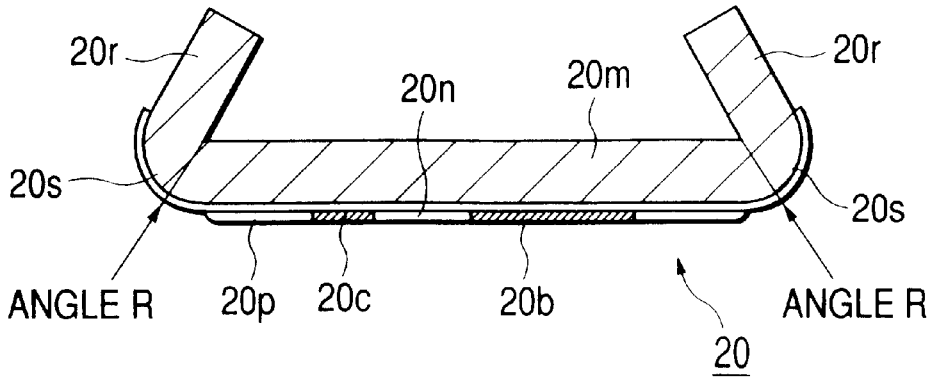

Though the ends of the metal substrate 20*m* of the metal substrate heater 20 are bent nearly at right angles so that the metal substrate 20*m* has the nearly U cross sectional shape in the above described embodiment, a metal substrate which has ends bent at an obtuse angle as shown in FIG. 20A or an acute angle as shown in FIG. 20B provides a similar effect.

Furthermore, the angle R provides a similar effect so far as a radius is longer than approximately 0.3 mm.

Figure 21:
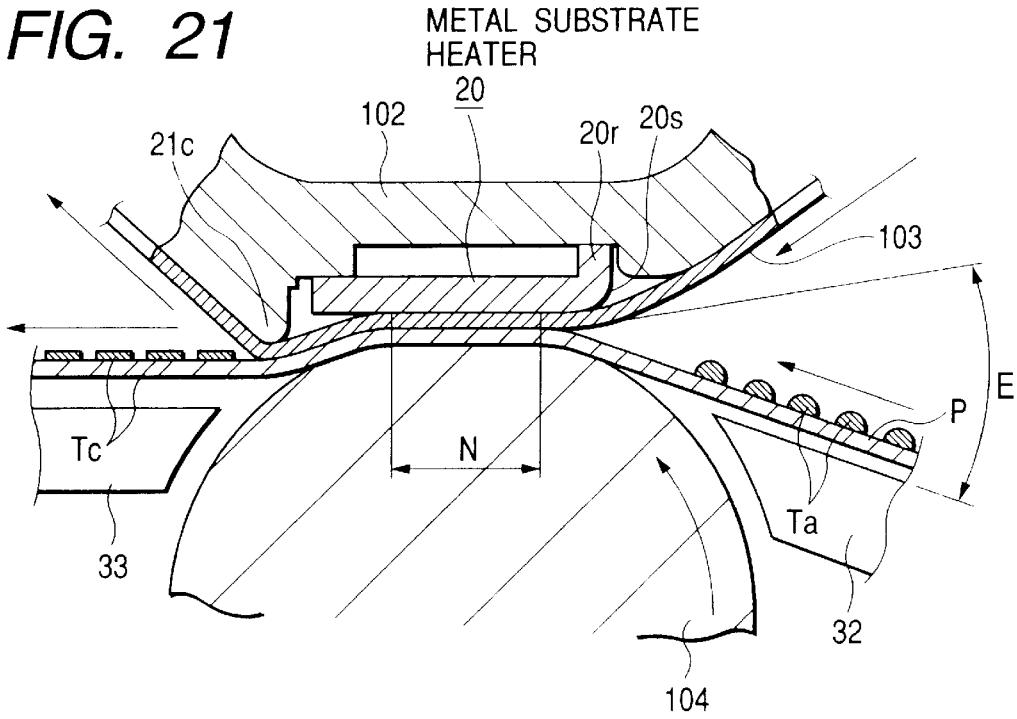
FIG. 21 is an enlarged view of a nip portion according to another embodiment.

The effects to prevent the image disturbance and curling of the leading end of the recording material P can be obtained also when only a downstream end in the moving direction of the fixing film of the metal substrate 20*m* is bent, an arc shape is formed on an angle portion and the downstream protrusion is removed from the heater holder 102 as shown in FIG. 21.

Figure 22:
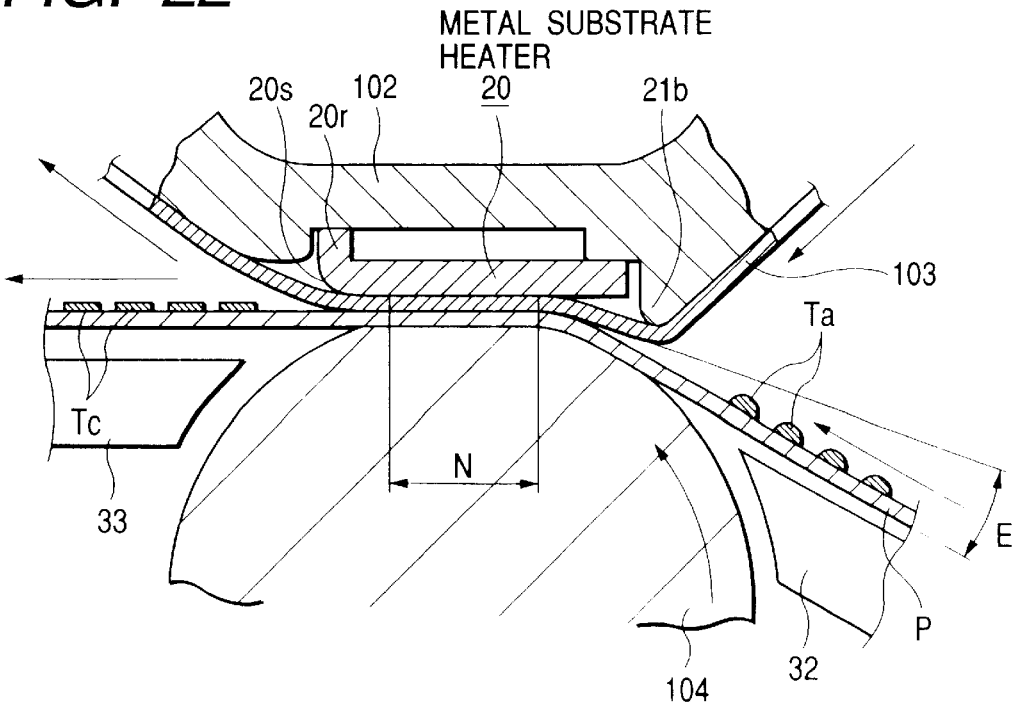
FIG. 22 is an enlarged view of a nip portion according to another embodiment.

The effect to prevent the image disturbance and resolutions of the problems of the paper clogging and paper wrinkling can be obtained also when only an upstream end in the moving direction of the fixing film of the metal substrate 20*m* of the metal substrate heater 20 is bent, an arc shape is formed on an angle portion and the upstream protrusion is removed from the heater holder 102 as shown in FIG. 22.

Though the metal substrate heater 20 has the configuration wherein the resistor layer pattern 20*b* which generates heat when power is supplied is disposed on the front surface (the surface opposite to the fixing film) by way of the insulating layer 20*n* of the metal substrate heater 20 in the above described embodiment, the metal substrate heater 20 may have a configuration wherein the resistor layer pattern 20*b* is disposed on a rear surface (a surface opposed to the surface opposite to the fixing film) of the metal substrate 20*m* through the insulating layer 20*n*.

Figure 23A:
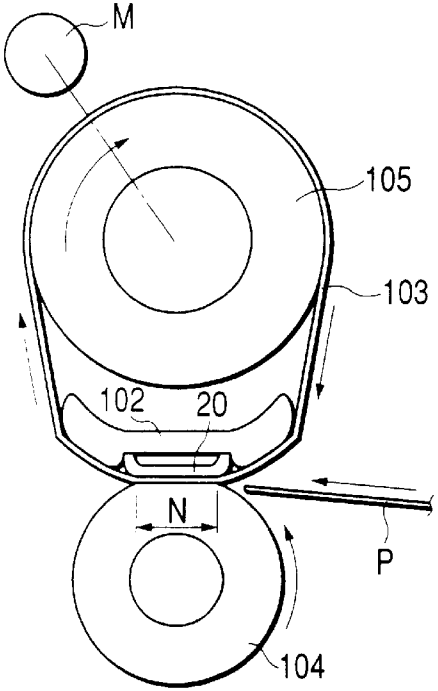
FIGS. 23A, 23B and 23C are diagrams showing an image heating apparatus to which the present invention is applicable.
Figure 23B:
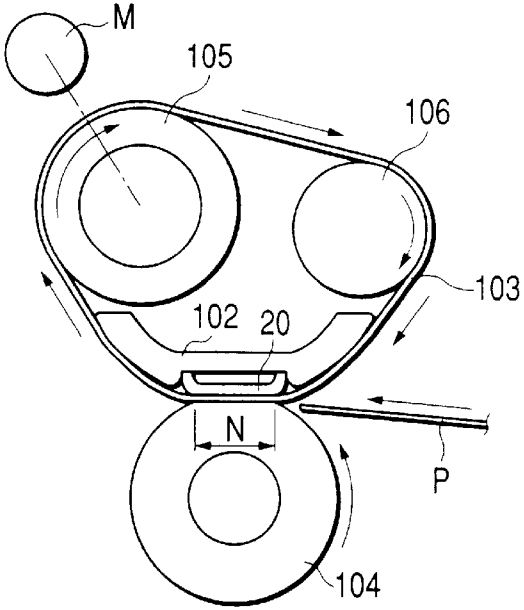
Figure 23C:
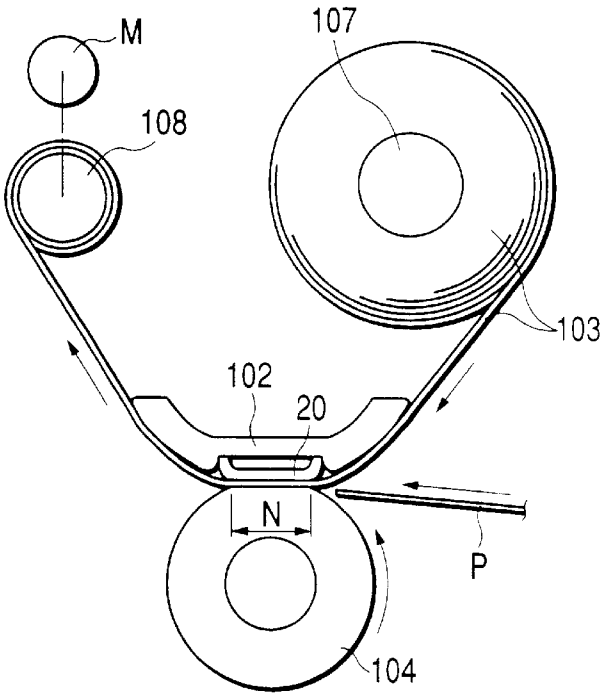

The film heating type heating apparatus is not limited to the pressurizing roller driving tensionless type described above as an example. FIGS. 23A, 23B and 23C exemplify configurational examples of the film heating type heating apparatus.

A heating apparatus shown in FIG. 23A has a configuration wherein an endless belt like fixing film 103 is wound and stretched around a metal substrate heater 20 supported in a heater holder 102 and a driving roller 105, and rotatingly driven with the driving roller 105. A pressurizing roller is configured as a driven runner roller.

A heating apparatus shown in FIG. 23B has a configuration wherein an endless belt like fixing film 103 is wound and stretched around a metal substrate heater 20, a driving roller 105 and a tension roller 106, and is rotatingly driven with the driving roller 105. A pressurizing roller 104 is configured as a driven runner roller.

A heating apparatus shown in FIG. 23C has a configuration wherein a long rolled film having ends is used as a fixing film 103 and moved at a predetermined speed from a side of a delivery shaft 107 to a side of a take-up shaft 108 through a nip portion between a metal substrate heater 20 supported in a heater holder 102 and a pressurizing roller 104. The pressurizing roller 104 is configured as a driven runner roller.

Now, description will be made of another embodiment which further enhances a sliding property.

Figure 24:
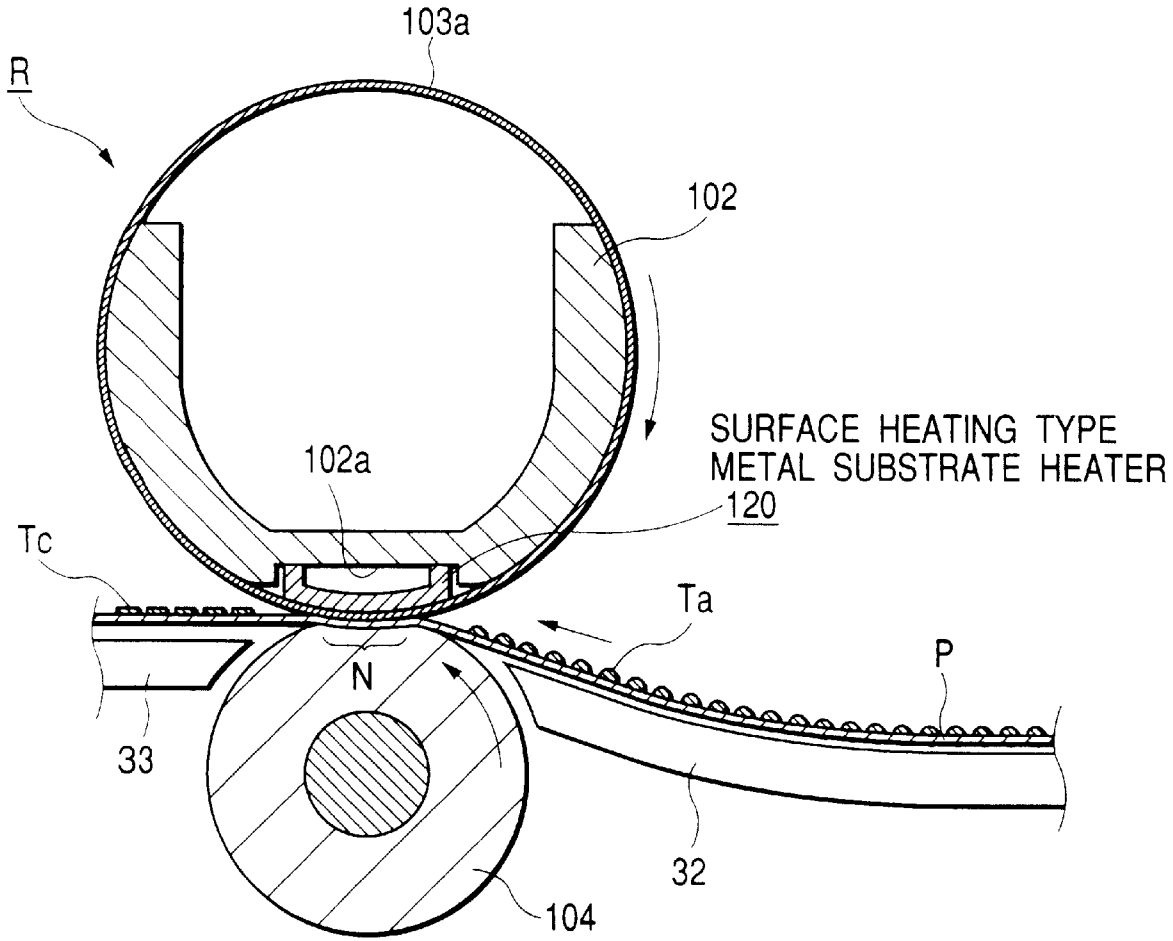
FIG. 24 is a diagram showing an image heating apparatus according to another embodiment of the present invention.
Figure 25:
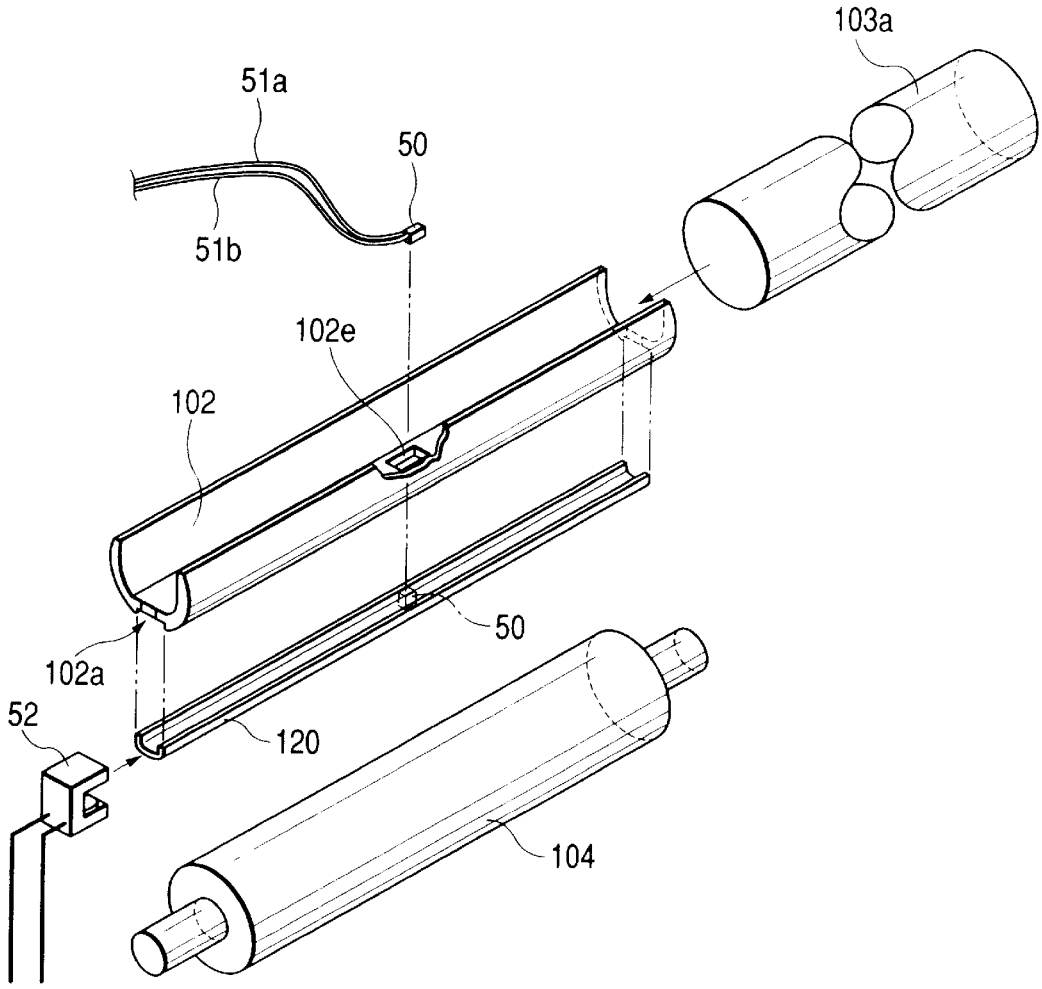
FIG. 25 is an exploded perspective view of the image heating apparatus.
Figure 26:
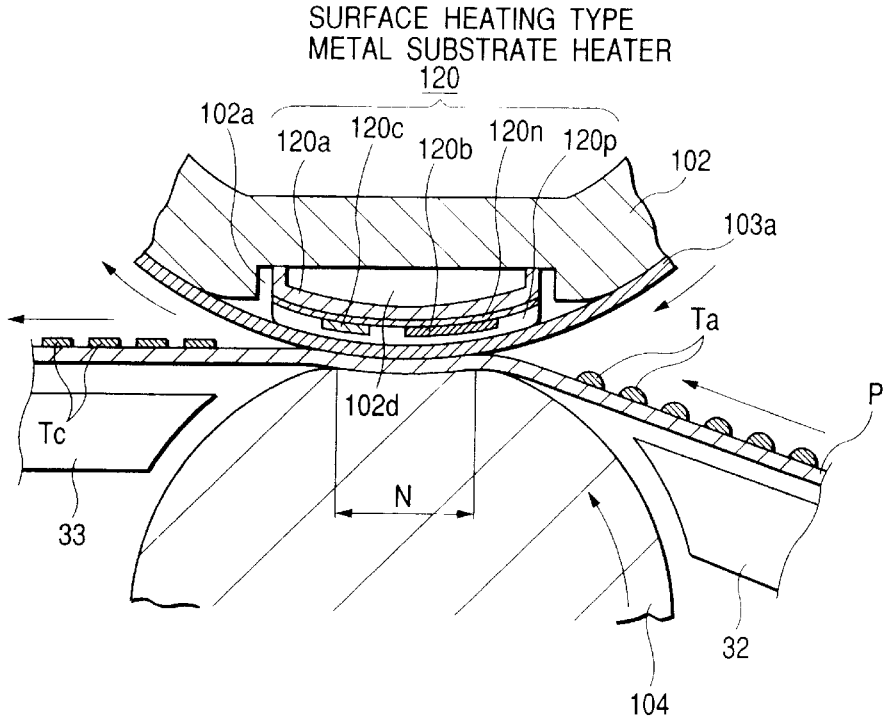
FIG. 26 is an enlarged view of a nip portion.

A fixing apparatus R is a sleeve heating type heating apparatus according to the present invention. FIG. 24 is a cross sectional view of main members, FIG. 25 is a partially cut perspective view of the main members and FIG. 26 is an enlarged view of a fixing nip portion.

Like the above described fixing apparatus shown in FIG. 14, the sleeve heating type fixing apparatus R is a pressurizing roller driving type apparatus using a cylindrical fixing sleeve 103*a*, and component members and parts which are common to the fixing apparatus shown in FIG. 14 will be denoted by the same reference numerals and not be described again.

Figure 29A:
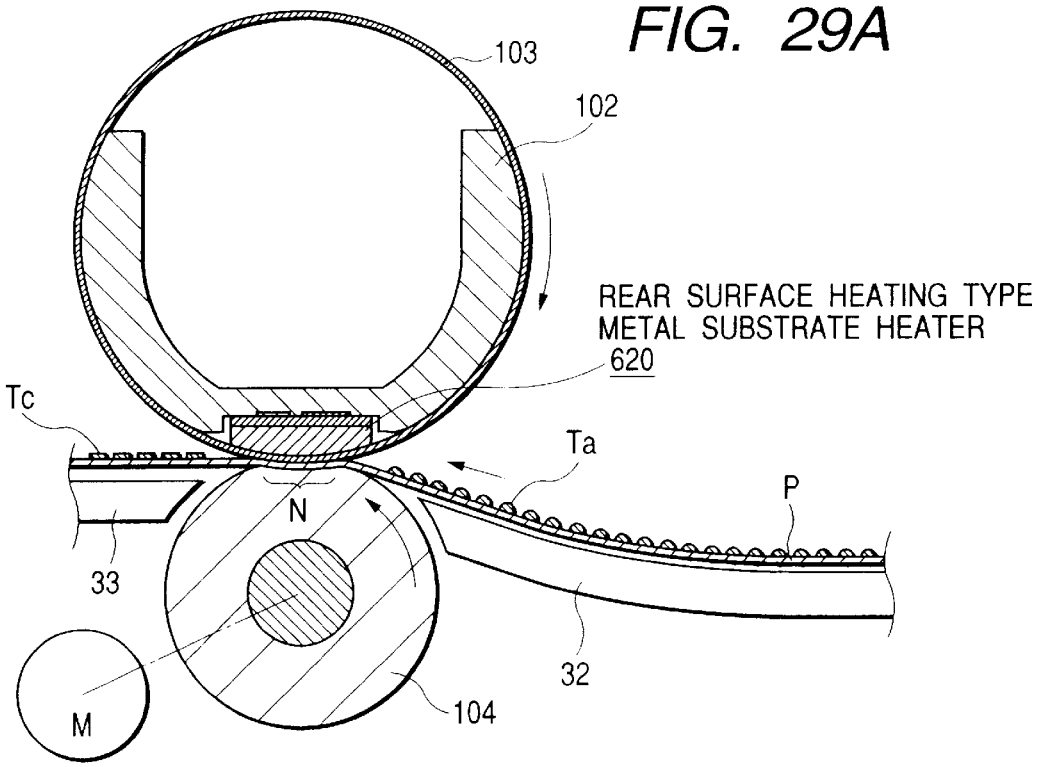
FIGS. 29A and 29B are diagrams showing a conventional image heating apparatus.
Figure 29B:
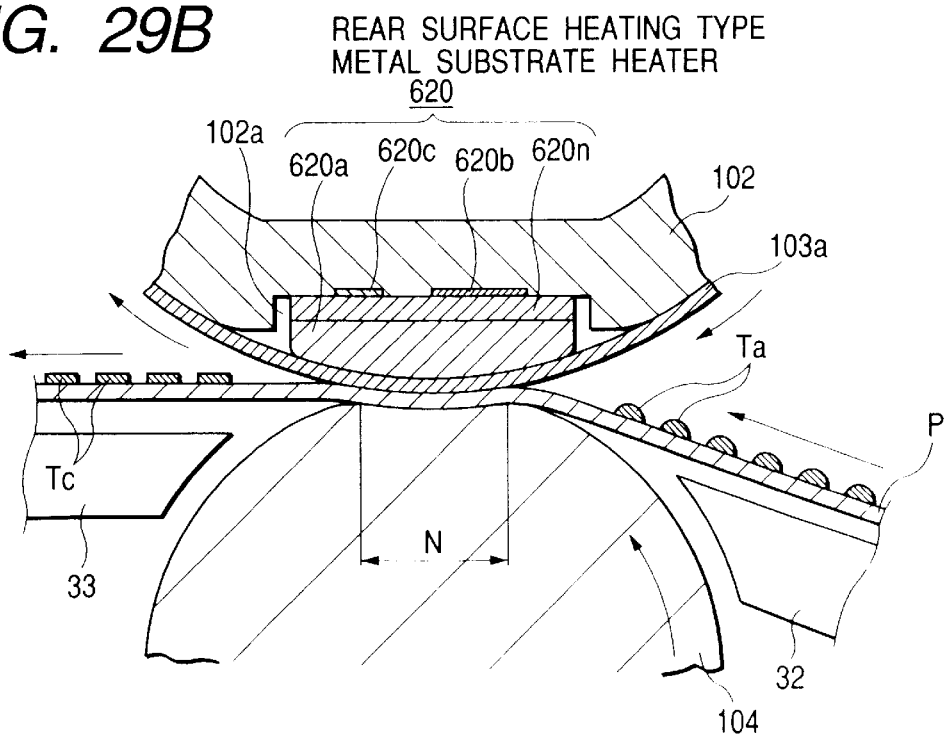

A heater 120 functioning as a heating body is not a metal substrate heater 620 which comprises a substrate 620*a* for heating a rear surface of a fixing apparatus in FIGS. 29A and 29B, but a front surface heating type metal substrate heater which comprises an insulating layer 20*n*, a heating resistor layer 20*b*, a surface protective layer 20*p* or the like on a front surface (on a side of a fixing sleeve) of a metal substrate which is curved as a heater substrate 120*a* having an arc like cross section and uniformly thick. This heater 120 will be described later.

A heater holder 102 is a member which is made of a liquid crystal polymer, phenolic resin, PPS, PEEK or the like and has a nearly semicircular cross section, and fitted and the heater 120 is supported in a groove 102*a* formed in a bottom surface of the heater holder 102 in a longitudinal direction of the holder in a condition where a front surface (surface on which the insulating layer 20*n*, the heating resistor layer 20*b*, the surface protective layer 20*p* or the like are formed) is set outside.

A fixing sleeve 103*a* is a cylindrical sleeve material and loosely fitted over the heater holder 102 supporting the above described heater 120. This embodiment uses a metal sleeve made of nickel or stainless steel which is excellent in heat conductivity, heat resistance and releasability. The fixing sleeve 103*a* is a member having a small heat capacity and a small thickness for enabling quick start, which is preferably not larger than 150 $\mu$m in the embodiment. In order to compose a heating fixing apparatus having a long service life, the fixing sleeve 103*a* must have a thickness not smaller than 20 $\mu$m as a sleeve which has sufficient strength and excellent durability. Accordingly, a thickness optimum for the fixing sleeve 103*a* is not smaller than 20 $\mu$m and not larger than 150 $\mu$m. In order to prevent offset and maintain a separating property of the recording material P, the front surface of the fixing sleeve 103*a* is coated with a mixture or a single component of PFA, PTFE, FEP, silicone resin or the like which has separative-type favorable releasability.

An elastic pressuring roller 104 functioning as a pressurizing member consists of a core metal and an elastic layer, for example, of heat-resistant rubber such as silicone rubber, fluororubber or expanded silicone rubber which is formed outside the core metal. A releasing layer of PFA, PTFE, FEP or the like may be formed outside the elastic layer.

In order to rotate the fixing sleeve 103*a* at a low torque and smoothly by driving it with the elastic pressurizing roller 104, it is necessary to keep frictional resistance among the metal substrate heater 120, the heater holder 102 and the fixing sleeve 103*a*. For this reason a small amount of lubricating agent is present among the metal substrate heater 120, the heater holder 102 and the fixing sleeve 103*a*.

Figure 27:
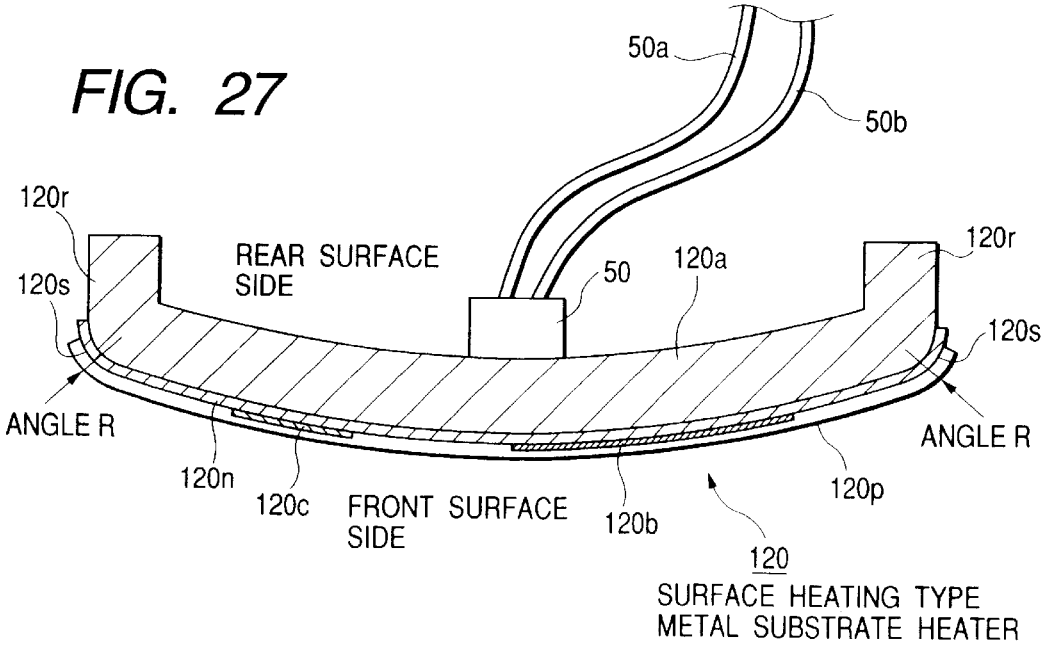
FIG. 27 is a side view of a heater.
Figure 28A:
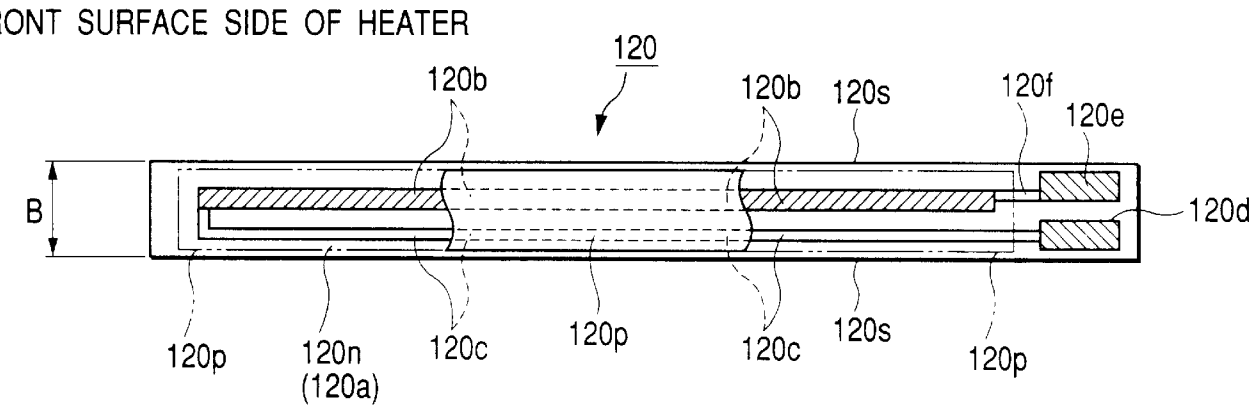
FIGS. 28A and 28B are plan views of the heater.
Figure 28B:
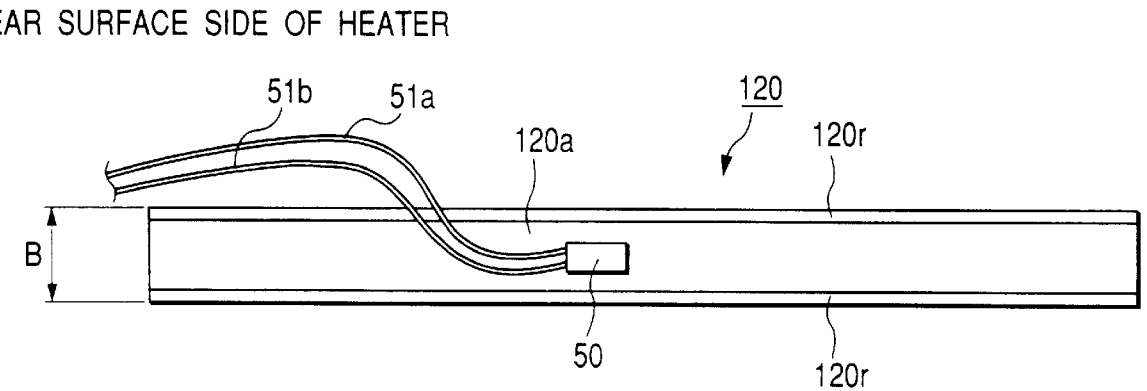

FIG. 27 is an enlarged cross sectional view of the heater 120, and FIG. 28A is a partially cut plan view of a front surface of the above described heater 120 and FIG. 28B is a plan view of the rear surface of the above described heater 120.

A heater substrate 120*a* of the heater 120 according to the embodiment is a metal substrate which is formed by bending a metal plate with curvature which is the same as that of an inner circumferential surface of the fixing sleeve 103*a* in a cross section. Used as a material of this metal substrate 120*a* is s stainless steel (SUS) material 0.3 mm thick, and an upstream end and a downstream end in a recording material conveying direction are bent on a side opposite to the fixing sleeve 103*a* so that the metal substrate 120 has leg sides 20*r* and 20*r*.

Furthermore, a portion of the heater 120 which is in contact with an inside surface of the fixing sleeve has an arc shape having curvature near the same as that of the inner circumferential surface of the fixing sleeve 103*a*, a radius of curvature of the arc is 24 mm, an angle R at two bent portions 20*s* and 20*s* has a radius of 0.5 mm, and external dimensions of the heater 120 are 270 mm in length, 10 mm in arc length and 2 mm in height of bent portion.

The insulating layer 20*n* coated with a heat-resistant glass having high insulating property is disposed on a front surface (on a side of the fixing sleeve) of the metal substrate 120*a*, thereby electrically insulating the heater substrate 120*a* which is electrically conductive from the heating resistor layer 20*b*, first and second electric conduction patterns 20*c*, 20*f* and first and second electrode portion patterns 20*d*, 20*e*. The glass insulating layer 20*n* is 50 $\mu$m thick, and formed by printing a glass paste by screen printing or the like and calcining the paste.

The heating resistor layer 20*b* is formed on the insulating layer 20*n* along a longitudinal side of the substrate by coating a paste of an electric resistor material (resistor paste) such as silver palladium (Ag/Pd) or $Ta_2N$, for example, in a thin belt like pattern 10 $\mu$m thick by 1 to 3 mm wide, for example, by screen printing and calcining this paste.

A first electric conduction path pattern 20*c* is formed in a thin belt like shape on the insulating layer 20*n* nearly in parallel with the above described heating resistor layer pattern. The two first and second electrode portion patterns 20*d* and 20*e* are formed on the insulating layer 20*n* side by side on a surface of a longitudinal end of the metal substrate 20*a*.

An end of the above described first electric conduction path pattern 20*c* is extended to be continuous and conductive to the first electrode portion pattern 20*d*. Furthermore, an end of the heating resistor layer pattern 20*b* is conductive to the second electrode portion pattern 20*e* by way of the second electric conduction path pattern 20*f*. The other end of the heating resistor layer pattern 20*b* is conductive to the other end of the first electric conduction path pattern 20*c*.

Accordingly, there is established a series of electric path from the first electrode portion pattern 20*d* to the second electrode portion pattern 20*e* by way of the first electric conduction path pattern 20*c*, the heating resistor layer pattern 20*b* and the second electric conduction path pattern 20*f* (an AC power supply electric path for the heating resistor layer pattern hereinafter referred to as an AC line).

Each of the above described first and second electrode portion patterns 20*d* and 20*e*, and the first and second electric conduction path patterns 20*c*, 20*f* is formed by pattern coating a paste of an electrically conductive material such as Ag by screen printing and calcining the paste.

The surface protective layer 20*p* is a heat-resistant glass layer which has, for example, Vickers hardness Hv on the order of $8.8\times10^9$ Pa (900 kg/mm$^2$) and thickness of 10 $\mu$m. Except portions on which the first and second electrode portion patterns 20*d* and 20*e*, the protective layer 20*p* covers the areas on which the heating resistor layer pattern 20*b*, and first and second electric conduction path patterns 20*c* and 20*f* are formed, whereby the heating resistor layer pattern 20*b*, and the first and second electric conduction path patterns 20*c* and 20*f* are covered with the protective layer 20*p* and protected against abrasion or the like.

The above described heater 120 is fitted and supported in a groove 102*a* formed in a bottom surface of the heater holder 102 in a longitudinal direction in a condition where a front surface of the heater 120 set downside and exposed.

A power supply connector 52 on a side of a power supply circuit is fitted over an end of the heater 120 on a side of the electrode portion patterns 20*d* and 20*e*, and two elastic electric contacts on a side of the above described connector are set in a condition where the contacts are in elastic contact with the first and second electrode portion patterns respectively, whereby the above described AC line on a side of the heater 120 is electrically connected to a power supply circuit (not shown).

Furthermore, a thermistor 50 functioning as a temperature detecting element is attached to a rear surface of the metal substrate 120*a* at a location in the vicinity of a center of the substrate so that the thermistor is kept by a spring (not shown) in close contact with the substrate 120*a* through a run-through hole 102*e* formed in the heater holder 102. Lead wires 51*a* and 51*b* are led from the thermistor 50 and electrically connected to a temperature control circuit (not shown) (DC line).

When power is supplied from the power supply circuit to the Ac line of the heater 120, the heating resistor layer pattern 20*b* generates heat from an entire longitudinal length, thereby raising a temperature of the heater 120 as a whole. A temperature rise of the heater 120 is detected by the thermistor 50 disposed on a rear surface of the heater and detected temperature information (a DC current) is fed back from the DC line to the temperature control circuit. The temperature control circuit controls the power supplied from the power supply circuit to the heating resistor layer pattern 20*b* of the AC line so that the temperature of the heater detected by the thermistor 50 is maintained at a definite temperature (fixing temperature). That is, the heater 120 is heated and controlled at a predetermined fixing temperature.

When the heater 120 overruns, a thermal fuse (not shown) connected in series with the AC line operates to emergently intercept power supply to the heater.

The heater 120 has the insulating layer 20*n*, the heating resistor layer 20*b* and the surface protective layer 20*p* which are disposed on the side of the front surface of the metal substrate 120*a* (on the side of the fixing sleeve) which is curved in the arc shape and uniformly thick described above, thereby being capable of preventing abrasion of the heater substrate 120*a* by reducing rotating resistance between the heater substrate 120*a* and the fixing sleeve 103*a*.

Since an inside surface of the fixing sleeve 103*a* is rounded, the inside surface of the fixing sleeve 103*a* can slide smoothly along the rounded corner portion (angle) 20*s* of the heater 120 even when the inside surface of the fixing sleeve comes into contact with the angle 20*s* of the heater 120.

Since the heater 120 is in contact with the heater holder 102 at thick plate portions of the inward bent leg sides 20*r* and 20*r*; and the leg sides 20*r* and 20*r* functioning as spacers forms the adiabatic space 102*d* between the rear surface of the metal substrate heater 120 and the heater holder 102, a contact area between the heater 120 and the heater holder 102 is narrow and heat dissipation from the heater 120 to the heater holder 102 is suppressed low, whereby heat energy can be supplied efficiently to a side of the fixing sleeve 103*a* and the recording material P.

Furthermore, the metal fixing sleeve 103*a* kept a heat conductivity low, thereby allowing heat generated by the heater 120 to be conducted with a high efficiency to the material P to be heated.

Furthermore, this embodiment is also capable of enhancing rigidity of the heater with the bent portions.

Furthermore, the fixing sleeve 103*a* which functions as a cylindrical member may be configured not as the pressurizing roller driving type but as a type rotatingly driven by another driving means such as that shown in FIGS. 23A, 23B and 23C.

Furthermore, the heater 120 can have a configuration where only either of the upstream edge or the downstream edge in the moving direction of the fixing sleeve 103*a* is bent on the side opposite to the fixing sleeve 103*a*.

The sleeve heating type heating apparatus according to the embodiment is capable of reducing rotating resistance since the surface of the heating body on the side brought into contact with the inside surface of the cylindrical member has the arc shape having curvature nearly the same as that of the cylindrical member and the cylindrical member can rotate in the circular locus as described above but also further reducing rotating resistance of the cylindrical member and preventing the heating body from being abraded since the insulating layer made of glass or the like which has sufficiently high hardness and sufficiently small surface roughness is coated and calcined on the surface of the heating body on which the cylindrical member slides.

In other words, the reduction of the rotating resistance makes it possible to prevent image disturbance from being produced due to a difference between a running speed of a recording material and a travelling speed of a cylindrical body in an image forming apparatus. Furthermore, the reduction of the rotating resistance makes it possible to prevent a material to be heated from slipping on a pressurizing member.

Furthermore, the substrate of the heating body composed of the metal substrate which is thick nearly uniformly reduces a heat capacity of the heating body, thereby quickening temperature rise of the heating body when power is supplied to the heating body.

Furthermore, the upstream edge or the downstream edge of the heating body in the moving direction of the cylindrical member which are bent on the side opposite to the cylindrical member allow the heating body to be in contact with a heating body holder member in a narrow area corresponding to thickness of the heating body and suppress heat dissipation from the heating body to the heating body holder member at a low level, thereby making it possible to supply heat energy to a side of the cylindrical member and the member to be heated, and enhance rigidity of the heater.

Furthermore, the cylindrical member which is composed of a thin metal having high heat conductivity makes it possible to transmit heat from the heating body to the member to be heated with efficiency higher than conventional and provides a result that a fixing control temperature can be set at a low level in an image forming apparatus, thereby being capable of preventing breakage of parts.

Furthermore, lowering of heat conductivity of the cylindrical member allows heat generated by the heating body to be efficiently transmitted to the material to be heated, thereby making it possible to suppress energy consumption at a low level.

Though a stainless steel material is used as the metal material for the heater substrate in the above described embodiments, effects of the present invention can be obtained using and working metals other than the stainless steel which have favorable malleabilities, ductibilities and heat conductivities.

Though the metal substrate is formed by bending a metal plate in the above described embodiments, similar effects can be obtained using a metal substrate which is formed by a working method such as sintering, casting or forging so far as a surface to be brought into contact with the fixing film or the fixing sleeve is smooth and nearly circular.

Furthermore, a pattern and a number of heating resistor layer patterns 20*b* for generating heat when power is supplied are not limited by the embodiments but optional. When the heating resistor layer patterns are to be formed, individual heating resistor layer pattern may be different in resistance values per unit length, material, widths, thicknesses or the like.

Furthermore, the heating apparatus according to the present invention is usable not only as the heating fixing apparatus according to the embodiments but also widely as an image heating apparatus which heats a recording material bearing an image for improving a surface property (luster), an image heating apparatus for temporal fixing, a heating apparatus for drying treatment and thermal laminating treatment of sheet like articles or the like.

While the present invention has been described above, the present invention is not limited to the embodiments in any respect but modifiable in any way within a technical concept of the present invention.

What is claimed is:

1. An image heating apparatus, comprising:

an elongated heater, said heater including a substrate made of a metal; and a film having a surface which slides on said heater and another surface which moves in contact with a recording material bearing an image, wherein the image on the recording material is heated by heat generated from said heater via said film, and said substrate includes a bent portion along a longitudinal direction of said heater.

2. An image forming apparatus according to claim 1, wherein said bent portion is disposed at a middle portion of said substrate in a direction perpendicular to the longitudinal direction of said heater.

3. An image heating apparatus according to claim 1, wherein said bent portion is disposed at an end portion of said substrate in a direction perpendicular to the longitudinal direction of said heater.

4. An image heating apparatus according to claim 3, wherein said bent portion is bent to a side opposite to a side of said film on said substrate.

5. An image heating apparatus according to claim 1, wherein said heater includes:

an electrically insulating layer disposed on said substrate;

a heat generating layer disposed on said electrically insulating layer; and a protective layer disposed on said heat generating layer.

6. An image heating apparatus according to claim 1, wherein said film has an endless shape, and said heater is disposed inside said film and a surface of said substrate on a side of said film has a curved shape convex to a side of said film.

7. A heater for heating an image, comprising:

an elongated substrate made of metal; and a heat generating layer disposed on said substrate, wherein said substrate includes a bent portion along a longitudinal direction of said substrate.

8. A heater for heating an image according to claim 7, wherein said bent portion is disposed at a middle portion of said substrate in a direction perpendicular to a longitudinal direction of said substrate.

9. A heater for heating an image according to claim 7, wherein said bent portion is disposed at an end portion of said substrate in a direction perpendicular to the longitudinal direction of said substrate.

10. A heater for heating an image according to claim 7, wherein said bent portion is bent to a side opposite to a side of said heat generating layer on said substrate.

11. A heater for heating an image according to claim 7, further comprising:

an electrically insulating layer provided on said substrate; and a protective layer, wherein said heat generating layer is disposed between said electrically insulating layer and said protective layer.

12. A heater for heating an image according to claim 7, wherein a surface of said substrate on a side of said heat generating layer has a curved shape convex outside.

13. A heater for heating an image according to claim 12, wherein the curved shape of said substrate is an arc shape.

14. An image heating apparatus according to claim 1, wherein said bent portion is provided at a upstream side and a downstream side of a movement direction of the recording material of said substrate, and said substrate between said two bent portions is configurated in curved shape with respect to the film side.

15. An image heating apparatus according to claim 14, wherein the curved shape of said substrate is an arc shape.

16. An image heating apparatus according to claim 14, wherein said heater includes an electrically insulating layer disposed on said substrate and a protective layer, and said heat generating layer is disposed between said electrically insulating layer and said protective layer.

17. A heater according to claim 7, wherein said bent portion is provided at both sides of an axial direction of said substrate, and said substrate between said two bent portions is configurated in curved shape.

18. A heater for heating an image according to claim 17, wherein the curved shape of said substrate is an arc shape.

19. A heater for heating an image according to claim 17, further comprising:

an electrically insulating layer disposed on said substrate; and a protective layer, wherein said heat generating layer is disposed between said electrically insulating layer and said protective layer.

* * * * *

UNITED STATES PATENT AND TRADEMARK OFFICE

CERTIFICATE OF CORRECTION

PATENT NO. : 6,583,389 B2
DATED : June 24, 2003
INVENTOR(S) : Ken Murooka et al.

It is certified that error appears in the above-identified patent and that said Letters Patent is hereby corrected as shown below:

Title page,
Item [75], Inventor, "Kita soma-gun (JP);" should read -- Kita Soma-gun (JP); --

Column 2,
Line 49, "incase" should read -- in case --.

Column 3,
Line 33, "the" should read -- of the --.

Column 13,
Line 61, "hip" should read -- nip --.

Column 20,
Line 50, "a" should read -- an --.

Signed and Sealed this

Sixteenth Day of December, 2003

JAMES E. ROGAN
*Director of the United States Patent and Trademark Office*